US010504406B2

(12) United States Patent
Shigeta et al.

(10) Patent No.: US 10,504,406 B2
(45) Date of Patent: Dec. 10, 2019

(54) PIXEL CIRCUIT OF DISPLAY PANEL AND DISPLAY DEVICE

(71) Applicant: SAMSUNG ELECTRONICS CO., LTD., Suwon-si (KR)

(72) Inventors: Tetsuya Shigeta, Suwon-si (KR); Sang-young Park, Suwon-si (KR); Ho-seop Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/900,025

(22) Filed: Feb. 20, 2018

(65) Prior Publication Data

US 2018/0293929 A1 Oct. 11, 2018

Related U.S. Application Data

(60) Provisional application No. 62/484,150, filed on Apr. 11, 2017.

(30) Foreign Application Priority Data

Sep. 21, 2017 (KR) ..... 10-2017-0121742

(51) Int. Cl.

| | |
|---|---|
| ***G09G 3/32*** | (2016.01) |
| ***G09G 3/20*** | (2006.01) |
| ***G09G 3/3233*** | (2016.01) |

(52) U.S. Cl.

CPC ..... *G09G 3/2081* (2013.01); *G09G 3/2011* (2013.01); *G09G 3/3233* (2013.01); (Continued)

(58) Field of Classification Search

CPC .. G09G 3/2081; G09G 3/2011; G09G 3/3233; G09G 3/2018; G09G 2310/0243; (Continued)

(56) References Cited

U.S. PATENT DOCUMENTS 7,277,072 B2 10/2007 Akimoto et al.
7,312,783 B2 12/2007 Oyama
(Continued)

FOREIGN PATENT DOCUMENTS

JP 5247172 B2 7/2013
KR 2003-0044566 A 6/2003
(Continued)

OTHER PUBLICATIONS

Communication dated Apr. 5, 2018, issued by the European Patent Office in counterpart European Patent Application No. 18155458.5.
(Continued)

*Primary Examiner* — Lisa S Landis
(74) *Attorney, Agent, or Firm* — Sughrue Mion, PLLC

(57) ABSTRACT

A pixel circuit of a display panel is provided, which includes a light emitting element configured to emit light in accordance with a drive current, a current source including a driving transistor connected to the light emitting element, and the current source is configured to provide the drive current having a different amplitude to the light emitting element in accordance with a level of a voltage applied to a gate terminal of the driving transistor, an amplitude setting circuit configured to apply a voltage having a different level to the gate terminal of the driving transistor, and a pulse width control circuit configured to control a duration of the drive current by controlling the voltage applied to the gate terminal of the driving transistor.

18 Claims, 21 Drawing Sheets

(52) U.S. Cl.
CPC ..... *G09G 3/2018* (2013.01); *G09G 2310/027* (2013.01); *G09G 2310/0243* (2013.01); *G09G 2320/0233* (2013.01); *G09G 2320/0242* (2013.01)

(58) Field of Classification Search
CPC ..... G09G 2310/027; G09G 2320/0233; G09G 2320/0242
See application file for complete search history.

(56) References Cited

U.S. PATENT DOCUMENTS

| | | | | |
|---|---|---|---|---|
| 7,495,397 | B2 | 2/2009 | Okabe | |
| 2004/0196221 | A1* | 10/2004 | Shih | G09G 3/3258 345/82 |
| 2006/0146827 | A1 | 7/2006 | Kim | |
| 2007/0279345 | A1 | 12/2007 | Kim | |
| 2009/0115703 | A1* | 5/2009 | Cok | G09G 3/3233 345/76 |
| 2011/0069098 | A1 | 3/2011 | Lee et al. | |
| 2012/0313923 | A1 | 12/2012 | Minami et al. | |
| 2013/0235090 | A1 | 9/2013 | Choi et al. | |
| 2014/0218414 | A1 | 8/2014 | Kikuchi et al. | |
| 2014/0362062 | A1* | 12/2014 | Limketkai | G09G 3/3233 345/205 |
| 2016/0133184 | A1 | 5/2016 | Gupta et al. | |

FOREIGN PATENT DOCUMENTS

| | | | |
|---|---|---|---|
| KR | 10-1164245 | B1 | 7/2012 |
| KR | 10-2013-0102406 | A | 9/2013 |
| KR | 10-1365345 | B1 | 2/2014 |

OTHER PUBLICATIONS

Search Report dated May 16, 2018, issued by the International Searching Authority in counterpart International Patent Application No. PCT/KR2018/001618 (PCT/ISA/210).
Written Opinion dated May 16, 2018, issued by the International Searching Authority in counterpart International Patent Application No. PCT/KR2018/001618 (PCT/ISA/237).
Communication dated Jul. 9, 2018, issued by the European Patent Office in counterpart European Application No. 18155458.5.
Communication dated Apr. 17, 2019, from the European Patent Office in counterpart European Application No. 18155458.5.

* cited by examiner (a)

(b)

(c)

PIXEL CIRCUIT OF DISPLAY PANEL AND DISPLAY DEVICE

CROSS-REFERENCE TO RELATED APPLICATIONS

This application claims priority from Korean Patent Application No. 10-2017-0121742 filed on Sep. 21, 2017 in the Korean Intellectual Property Office, and the benefit of U.S. Provisional Patent Application No. 62/484,150 filed on Apr. 11, 2017 in the United States Patent and Trademark Office, the disclosures of which are incorporated herein by reference in their entireties.

BACKGROUND

Field

The present disclosure relates to a pixel circuit of a display panel and a display device, and more particularly, to a pixel circuit of a display panel that expresses grayscales in accordance with an amplitude and a duration of a drive current and a display device.

Description of the Related Art

A light emitting diode (LED) display panel in the related art mainly adopts passive matrix (PM) driving, but active matrix (AM) driving is necessary for low power consumption. Recently, an AM driving circuit has been applied to an organic light emitting diode (OLED) display panel. However, in the case of the LED that is different from the OLED, a color shift phenomenon due to forward voltage (Vf) deviation between LEDs or the size of a drive current becomes greater than that of the OLED, and thus it is difficult to apply the AM driving circuit, which has been applied to the OLED display, to the LED display as it is.

Specifically, a pulse amplitude modulation (PAM) driving method in which an amplitude of a drive current differs for each grayscale for grayscale expression has been widely adopted in the OLED display, but if a PAM driving circuit in the related art is applied to the LED display as it is, a color shift problem that a color is greatly changed for each grayscale may occur.

Further, in a pulse width modulation (PWM) driving method in which the pulse width (or duty ratio) of a drive current differs depending on the grayscale, a PWM driving circuit in the related art drives thin film transistors (TFTs) in a linear operation region, and thus luminance difference due to the forward voltage deviation of the LED greatly occurs. Particularly, in the case of a digital PWM method, since grayscales are expressed in a sub field method, the number of grayscales that can be expressed is limited, and a false contour problem occurs.

Accordingly, there has been a need for a low-power AM driving circuit having high luminance uniformity and low color shift.

SUMMARY

Example embodiments may overcome the above disadvantages and other disadvantages not described above, and provide a pixel circuit of a display panel having high luminance uniformity and low color shift and a display device.

According to an aspect of an example embodiment, there is provided a pixel circuit of a display panel including: a light emitting element configured to emit light in accordance with a drive current; a current source including a driving transistor connected to the light emitting element, and the current source is configured to provide the drive current having a different amplitude to the light emitting element in accordance with a level of a voltage applied to a gate terminal of the driving transistor; an amplitude setting circuit configured to apply a voltage having a different level to the gate terminal of the driving transistor; and a pulse width control circuit configured to control a duration of the drive current by controlling the voltage applied to the gate terminal of the driving transistor.

The driving transistor may operate in a saturation region of an operation region of the driving transistor.

The light emitting element may be a light emitting diode (LED) or an organic light emitting diode (OLED).

The amplitude setting circuit may include: a first capacitor having a first end connected to a first end of the driving transistor; and a first transistor having a first end commonly connected to a second end of the first capacitor and the gate terminal of the driving transistor and a second end configured to receive an input of an amplitude setup voltage.

The amplitude setting circuit may be further configured to charge the first capacitor with the amplitude setup voltage while the first transistor is turned on in accordance with a first enable signal input to a gate terminal of the first transistor, and apply the voltage charged in the first capacitor to the gate terminal of the driving transistor.

The current source may be further configured to, in response to a drive voltage being applied to the current source in a state in which the voltage charged in the first capacitor is applied to the gate terminal of the driving transistor, provide to the light emitting element the drive current having an amplitude corresponding to a level of the voltage charged in the first capacitor.

The amplitude setting circuit may include a second transistor having a first end connected to a second end of the driving transistor, a gate terminal connected to a gate terminal of the first transistor, and a second end configured to receive an input of an amplitude setup current, wherein the amplitude setting circuit may be further configured to charge the first capacitor with a voltage corresponding to the amplitude setup current while the first transistor and the second transistor are turned on in accordance with a first enable signal input to a gate terminal of the first transistor, and apply the voltage charged in the first capacitor to the gate terminal of the driving transistor.

The pulse width control circuit may include an inverter having an output end connected to the gate terminal of the driving transistor, wherein in response to a first voltage applied to an input end of the inverter being linearly changed to reach a predetermined threshold voltage, a voltage of the output end of the inverter becomes a ground voltage or a drive voltage of the current source to control the duration of the drive current.

The pulse width control circuit may include: a complementary metal oxide semiconductor field effect transistor (CMOSFET) inverter having an output end connected to the input end of the inverter; a third capacitor having a first end connected to an input end of the CMOSFET inverter; and a switching element connected between the input end and the output end of the CMOSFET inverter, wherein if the switching element is turned on while a pulse width setup voltage is input to a second end of the third capacitor, the input end of the inverter may be set to the predetermined threshold voltage while the switching element is turned on, and in response to the input of the pulse width setup voltage being completed, the voltage of the input end of the inverter may be changed from the predetermined threshold voltage to the first voltage.

The drive current may sustain from a time when the drive voltage is applied to the current source to a time when the voltage of the output end of the inverter becomes the ground voltage or the drive voltage.

The pulse width control circuit may include: a switching element connected between the input end and the output end of the inverter; and a second capacitor having a first end connected to the input end of the inverter, wherein if the switching element is turned on while a pulse width setup voltage is input to a second end of the second capacitor, the input end of the inverter may be set to the predetermined threshold voltage while the switching element is turned on, and in response to the input of the pulse width setup voltage being completed, the voltage of the input end of the inverter changes from the predetermined threshold voltage to the first voltage.

The first voltage may be a difference value between the predetermined threshold voltage and the pulse width setup voltage.

The pulse width control circuit may be configured to linearly change the first voltage as the drive voltage is applied to the current source and a linearly changing voltage is input to the second end of the second capacitor.

Each of the inverter and the switching element may be an N-channel metal oxide semiconductor field effect transistor (NMOSFET), the inverter may include a drain terminal connected to the gate terminal of the driving transistor, a gate terminal connected to the first end of the second capacitor, and a source terminal connected to a ground, the switching element may include a drain terminal commonly connected to the gate terminal of the inverter and the first end of the second capacitor, and a source terminal commonly connected to the drain terminal of the inverter and the gate terminal of the driving transistor, and in response to the first voltage applied to the gate terminal of the inverter being linearly increased and reaching the predetermined threshold voltage, a voltage of the drain terminal of the inverter becomes the ground voltage.

The pulse width control circuit may be configured so that in response to a second enable signal being input to a gate terminal of the switching element while a pulse width setup voltage of a second voltage is input to the second end of the second capacitor, the voltage of the gate terminal of the inverter may be set to the predetermined threshold voltage while the switching element is turned on in accordance with the second enable signal, and as the pulse width setup voltage is dropped from the second voltage to a zero voltage, the voltage of the gate terminal of the inverter may be dropped from the predetermined threshold voltage to the first voltage.

Each of the inverter and the switching element may be a P-channel metal oxide semiconductor field effect transistor (PMOSFET), the inverter may include a drain terminal connected to the gate terminal of the driving transistor, a gate terminal connected to the first end of the second capacitor, and a source terminal connected to a drive voltage input end of the current source, the switching element may include a source terminal commonly connected to the gate terminal of the inverter and the first end of the second capacitor, and a drain terminal commonly connected to the drain terminal of the inverter and the gate terminal of the driving transistor, and in response to the first voltage applied to the gate terminal of the inverter being linearly decreased and reaching the predetermined threshold voltage, a voltage of the drain terminal of the inverter becomes the drive voltage of the current source.

The pulse width control circuit may be configured so that if a third enable signal is input to a gate terminal of the switching element while a pulse width setup voltage of a third voltage is input to the second end of the second capacitor, the voltage of the gate terminal of the inverter may be set to the predetermined threshold voltage while the switching element is turned on in accordance with the third enable signal, and as the pulse width setup voltage rises from the third voltage to a zero voltage, the voltage of the gate terminal of the inverter rises from the predetermined threshold voltage to the first voltage.

The pixel circuit may include a third transistor configured to electrically separate the amplitude setting circuit and the pulse width control circuit from each other until the drive voltage is applied to the current source.

According to an aspect of another example embodiment, there is provided a display device including: a display panel including pixel circuits, and the display panel is configured to display an image; a panel driver configured to drive the display panel; and a processor configured to express grayscales of the image based on at least one from among an amplitude and a duration of a drive current applied to a light emitting element included in the pixel circuits, wherein each of the pixel circuits includes: the light emitting element configured to emit light in accordance with the drive current; a current source including a driving transistor connected to the light emitting element, and the current source is configured to provide the drive current having a different amplitude to the light emitting element in accordance with a level of a voltage applied to a gate terminal of the driving transistor; and a pulse width control circuit configured to control the duration of the drive current by controlling the voltage applied to the gate terminal of the driving transistor.

According to example embodiments as described above, a pixel circuit of a display panel having high luminance uniformity and low color shift and a display device can be provided.

Additional and/or other aspects and advantages will be set forth in part in the description which follows and, in part, will be obvious from the description, or may be learned by practice of example embodiments.

BRIEF DESCRIPTION OF THE DRAWINGS

The above and/or other aspects will be more apparent by describing example embodiments with reference to the accompanying drawings, in which.

DETAILED DESCRIPTION OF THE EXAMPLE EMBODIMENTS

Hereinafter, example embodiments will be described in detail with reference to the accompanying drawings. In describing the present disclosure, related well-known technologies are not described in detail if they would obscure the subject matter of the present disclosure with unnecessary detail. Further, a suffix "unit" of a constituent element used in the following description may be given or mixedly used in consideration of easy preparation of the description only, but does not have any distinguishable meaning or role by itself.

The terms used in the description are used to merely describe example embodiments, but are not intended to limit and/or restrict the present disclosure. A singular expression may include a plural expression unless specially described on the context.

In the description, the term "includes" or "has" used in the description represents that features, figures, steps, operations, constituent elements, components, or combinations thereof exist, and thus the term should be understood that existence or addition of one or more other features, figures, steps, operations, constituent elements, components, or combinations thereof are not pre-excluded.

Further, in example embodiments, if it is described that a certain portion is connected to another portion, it means not only a direct connection but also an indirect connection through another medium. Further, if it is described that a certain portion includes a certain constituent element, it means that the certain portion does not exclude other constituent elements, but may further include the other constituent elements unless specially described on the contrary.

Figure 1:
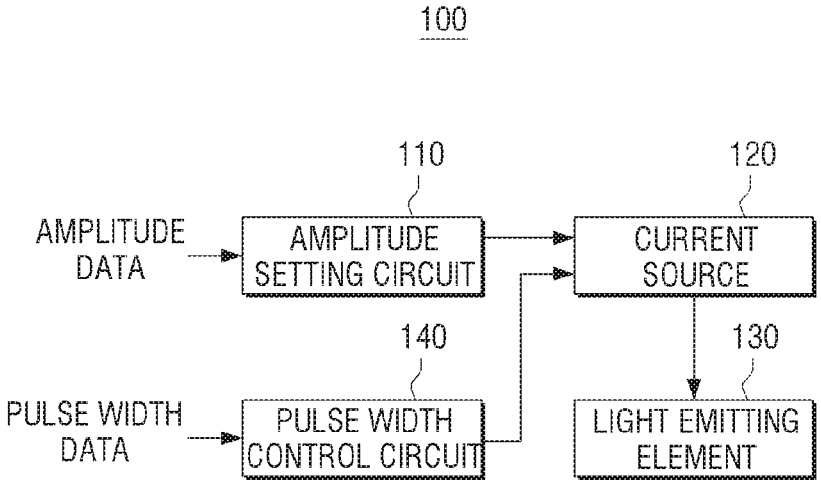
FIG. 1 is a block diagram of a pixel circuit according to an example embodiment.
Figure 11:
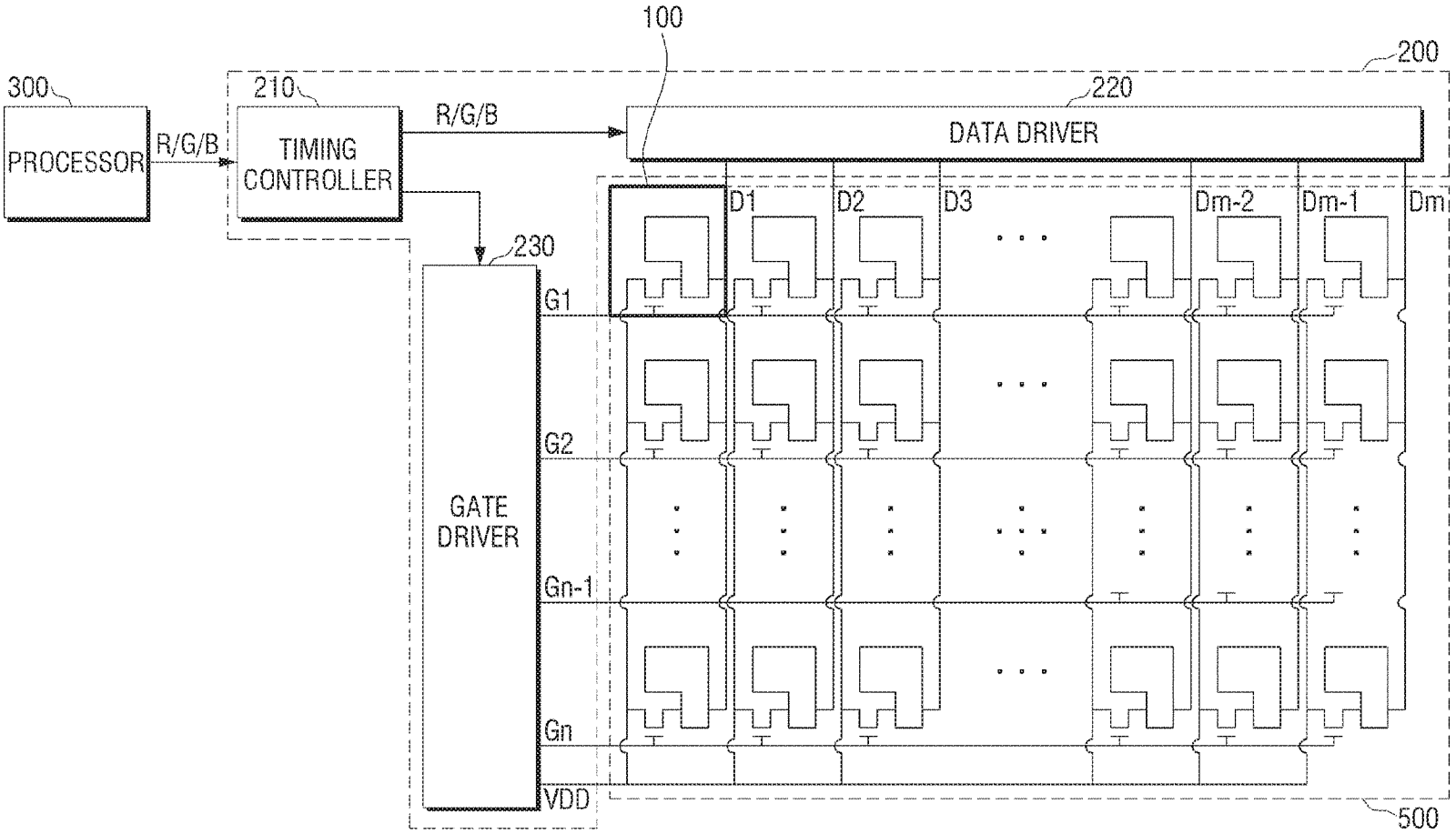
FIG. 11 is a diagram illustrating the configuration of a display device according to an example embodiment.

FIG. 1 is a block diagram of a pixel circuit according to an example embodiment. In general, a display device includes a display panel, and the display panel includes a plurality of pixels. In this case, each of the plurality of pixels included in the display panel may be implemented by a light emitting element and a surrounding circuit for driving the light emitting element. Referring to FIG. 11, in various example embodiments, a pixel circuit 100 means a circuit constituting each of the plurality of pixels of the display panel 500.

Referring to FIG. 1, the pixel circuit 100 includes an amplitude setting circuit 110, a current source 120, a light emitting element 130, and a pulse width control circuit 140.

The light emitting element 130 emits light in accordance with a drive current provided from the current source 120. Specifically, the light emitting element 130 may emit light at different luminance levels in accordance with the amplitude of a drive current provided from the current source 120 or the pulse width of the drive current. Here, the pulse width of the drive current may be expressed as the duty ratio of the drive current or the duration of the drive current.

For example, the light emitting element 130 can emit light at a higher luminance level as the amplitude of the drive current becomes larger and as the pulse width becomes longer (i.e., as the duty ratio becomes higher or the duration becomes longer), but is not limited thereto.

On the other hand, the light emitting element 130 may be a light emitting diode (LED) or an organic light emitting diode (OLED).

Figure 2A:
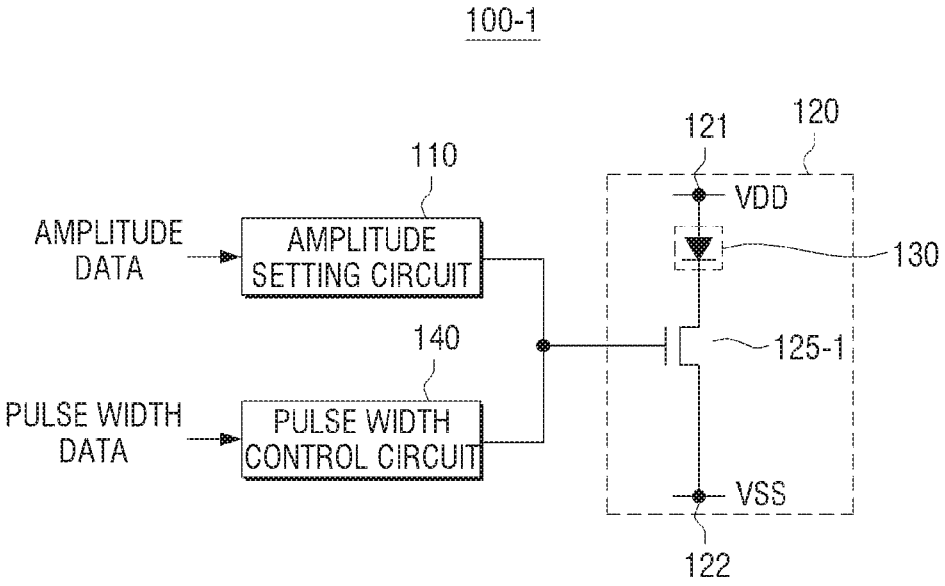
FIGS. 2A and 2B are circuit diagrams schematically illustrating a pixel circuit according to an example embodiment.
Figure 2B:
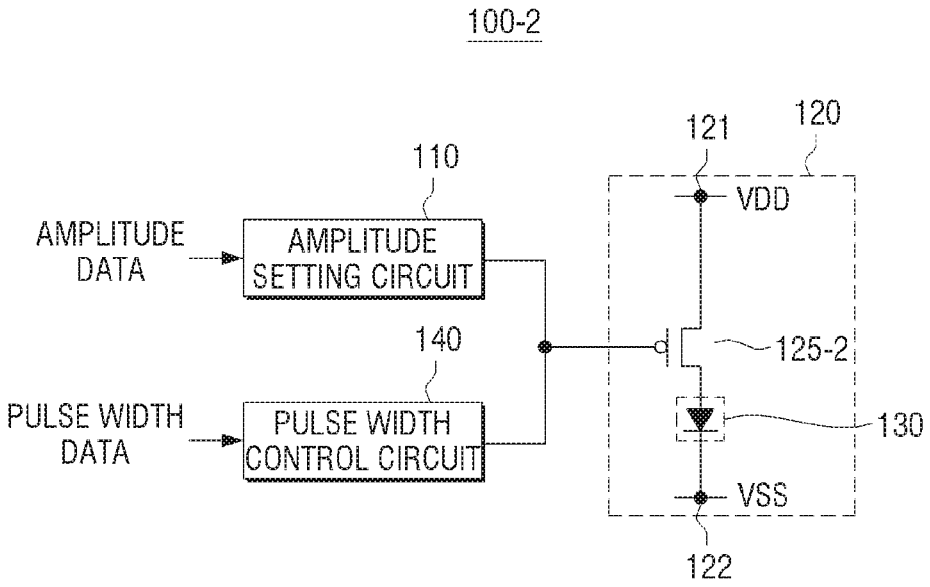

The current source 120 provides the drive current to the light emitting element 130. In particular, as illustrated in FIGS. 2A and 2B, the current source 120 includes a driving transistor 125-1 or 125-2 connected to the light emitting element 130, and may provide the drive current with a different amplitude to the light emitting element in accordance with the level of a voltage applied to a gate terminal of the driving transistor 125-1 or 125-2.

Specifically, the current source 120 may provide the drive current having an amplitude set through the amplitude setting circuit 110 to the light emitting element 130, and may provide the drive current having a pulse width set by the pulse width control circuit 140 to the light emitting element 130.

The amplitude setting circuit 110 may set the amplitude of the voltage to be applied to the gate terminal 125-1 or 125-2 of the driving transistor included in the current source 120 in accordance with amplitude data. Here, the amplitude data may be an amplitude setup voltage to be described later, but is not limited thereto.

The pulse width control circuit 140 may control the duration of the drive current by controlling the voltage applied to the gate terminal 125-1 or 125-2 of the driving transistor included in the current source 120 in accordance with pulse width data. Here, the pulse width data may be a pulse width setup voltage to be described later, but is not limited thereto.

FIGS. 2A and 2B are circuit diagrams schematically illustrating a pixel circuit according to an example embodiment. In explaining FIGS. 2A and 2B, explanation of the duplicate contents as described above with reference to FIG. 1 will be omitted.

FIG. 2A illustrates a pixel circuit 100-1 provided with an N-channel metal oxide semiconductor field effect transistor (NMOSFET) as the driving transistor included in the current source 120, and FIG. 2B illustrates a pixel circuit 100-2 provided with a P-channel metal oxide semiconductor field effect transistor (PMOSFET) as the driving transistor included in the current source 120.

As illustrated in FIGS. 2A and 2B, the current source 120 of the pixel circuit 100-1 or 100-2 includes the driving transistor 125-1 or 125-2, and it can be seen that one end of the driving transistor 125-1 or 125-2 is connected to the light emitting element 130. For example, the driving transistor 125-1 or 125-2, a drive voltage terminal 121, and a ground terminal 122 may constitute the current source 120, but are not limited thereto.

Specifically, referring to FIG. 2A, if the driving transistor 125-1 is an NMOSFET, the drain terminal of the driving transistor 125-1 is connected to the drive voltage terminal 122 to which the drive voltage VDD is applied through the light emitting element 130, and the source terminal thereof is connected to the ground terminal 122. Accordingly, if a voltage that is equal to or higher than a threshold voltage is applied between the gate terminal and the source terminal of the driving transistor 125-1, the driving transistor 125-1 is turned on, and the drive current may flow from the drive voltage terminal 121 to the ground (VSS) terminal 122 to cause the light emitting element 130 to emit light.

On the other hand, referring to FIG. 2B, if the driving transistor 125-2 is a PMOSFET, the source terminal of the driving transistor 125-2 is connected to the drive voltage terminal 121, and the drain terminal thereof is connected to the ground terminal 122 through the light emitting element 130. In this case, if a voltage that is lower than the threshold voltage is applied between the gate terminal and the source terminal of the driving transistor 125-2, the driving transistor 125-2 is turned on, and the drive current may flow from the drive voltage terminal 121 to the ground terminal 122 to cause the light emitting element 130 to emit light.

Here, the threshold voltage of the NMOSFET may have a positive value and the threshold voltage of the PMOSFET may have a negative value, but are not limited thereto. Further, the voltage VSS of the ground terminal 122 connected to the source terminal of the NMOSFET or the drain terminal of the PMOSFET may be a zero-volt voltage, but is not limited thereto. Of course, the ground voltage may be designed to have a predetermined level according to an example embodiment.

Hereinafter, the operation of the driving transistor 125-1 or 125-2 according to an example embodiment will be described in more detail with reference to FIGS. 3A and 3B.

Figure 3A:
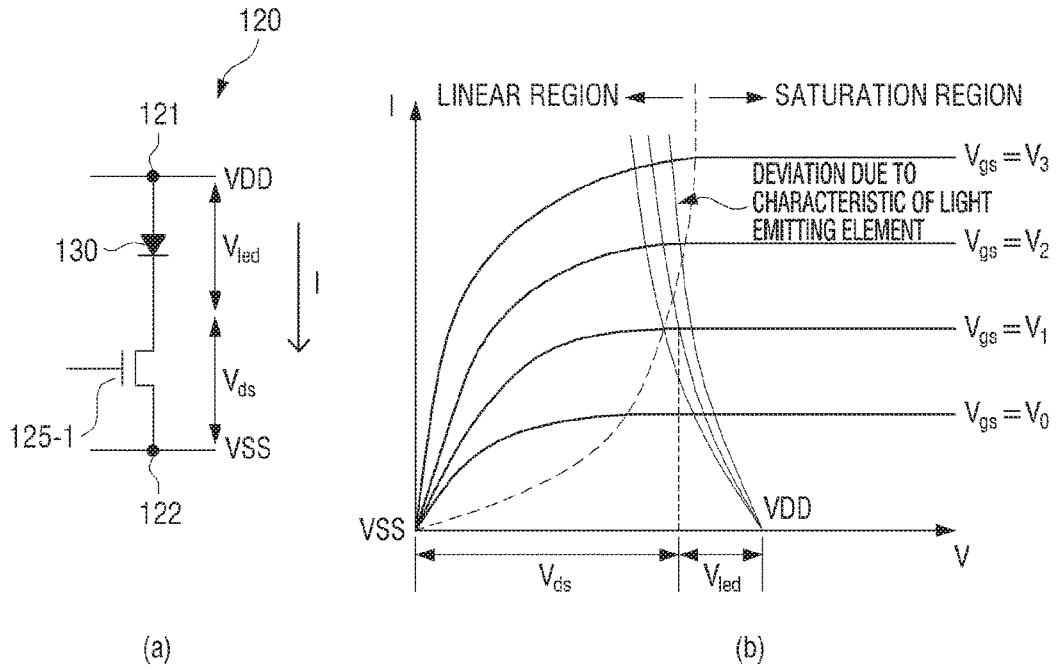
FIGS. 3A and 3B are diagrams explaining the operation of a pixel circuit in the case where a driving transistor included in a current source is an NMOSFET or a PMOSFET according to an example embodiment.

FIG. 3A is diagram explaining a case where the driving transistor 125-1 included in the current source 120 is the NMOSFET.

(a) of the FIG. 3A illustrates the current source 120 and the light emitting element 130 of the pixel circuit 100-1 of FIG. 2A. As illustrated in (a) of the FIG. 3A, if the driving transistor is the NMOSFET 125-1, the drain terminal of the NMOSFET 125-1 is connected to a cathode terminal of the light emitting element 130, and the source terminal thereof is connected to the ground terminal 122. Further, an anode terminal of the light emitting element 130 is connected to the drive voltage terminal 121 of the current source. Accordingly, if the NMOSFET 125-1 is turned on in accordance with the gate terminal voltage of the NMOSFET 125-1, the current source 120 may provide the drive current I to the light emitting element.

On the other hand, (b) of the FIG. 3A is a graph illustrating the voltage-current characteristic of the NMOSFET 125-1. In (b) of the FIG. 3A, the horizontal axis represents a drain-source voltage Vds of the NMOSFET 125-1, and the vertical axis represents the current I that flows from the drain terminal to the source terminal in accordance with the drain-source voltage Vds.

As illustrated in (b) of the FIG. 3A, if the gate-source voltage Vgs of the NMOSFET 125-1 is equal to or higher than the threshold voltage, much more current I flows as the gate-source voltage Vgs becomes higher (i.e., goes from V0 to V3). Accordingly, the current source 120 may provide the drive current having a different amplitude to the light emitting element 130 in accordance with the level of the voltage applied to the gate terminal of the driving transistor 125-1.

Further, the NMOSFET 125-1 may operate in a linear region or in a saturation region in accordance with the drain-source voltage Vds for each gate-source voltage Vgs that is equal to or higher than the threshold voltage. Here, the linear region is a region in which the current I flowing from the drain terminal to the source terminal becomes larger as the drain-source voltage Vds becomes higher, and the saturation region is an operation region in which the current I flowing from the drain terminal to the source terminal becomes constant regardless of the change of the drain-source voltage Vds. That is, as illustrated in (b) of the FIG. 3A, the NMOSFET 125-1 has the linear region and the saturation region in the case where Vgs is V0 to V3.

On the other hand, the drive voltage VDD applied to the drive voltage terminal 121 is divided into Vled and Vds as illustrated in FIG. 3A(A) between the NMOSFET 125-1 and the light emitting element 130. Here, Vds is a drain-source voltage of the NMOSFET 125-1, and Vled is a forward voltage Vf of the light emitting element 130, that is, a voltage that is required for the light emitting element 130 to emit light.

As illustrated in (b) of the FIG. 3A, the forward voltage Vf of the light emitting element may have a deviation for each light emitting element, and in the case where the light emitting element operates in the linear region of the driving transistor 125-1, voltage division between Vled and Vds differs due to such a deviation, and thus the drive current I differs to cause luminance deviation between the light emitting elements to occur even with respect to the same drive voltage VDD.

However, according to an example embodiment, since the pixel circuit 100-1 or 100-2 includes the amplitude setting circuit 110 for applying voltages having different levels to the gate terminal of the driving transistor 125-1 or 125-2, the operating point of the driving transistor 125-1 can be set through the amplitude setting circuit 110, and thus it is possible to operate the light emitting element 130 in the saturation region of the driving transistor 125-1 or 125-2.

For example, if the pixel circuit 100-1 applies a voltage, such as V2 or V3, to the gate terminal of the NMOSFET 125-1 in a situation as shown in (b) of the FIG. 3A, the light emitting elements are operated in the linear region of the NMOSFET 125-1. In this case, due to the deviation Vf between the light emitting elements, the voltage division between Vled and Vds differs, and thus the drive current I provided to the light emitting element differs to cause the luminance deviation between the light emitting elements to occur.

However, according to an example embodiment, the pixel circuit 100-1 may make the light emitting element 130 operate in the saturation region of the NMOSFET 125-1 by applying V0 or V1 as the Vgs value through the amplitude setting circuit 110. If the NMOSFET 125-1 operates in the saturation region, the current I becomes constant regardless of the change of Vds. Accordingly, even if the voltage division between Vled and Vds is changed due to the deviation Vf between the light emitting elements, the drive current I provided to the light emitting element 130 becomes constant, and thus the light emitting elements can emit light having a constant luminance value regardless of the forward voltage deviation. On the other hand, according to an example embodiment, the drive voltage VDD applied to the current source 120 may be designed to be high, so that the light emitting element 130 can operate in the saturation region of the NMOSFET 125-1.

On the other hand, according to an example embodiment, even if the driving transistor included in the current source 120 is a PMOSFET, the pixel circuit may be designed to operate in the same manner as described above with reference to FIG. 3A. Hereinafter, a case where the driving transistor is the PMOSFET will be described with reference to FIG. 3B.

Figure 3B:
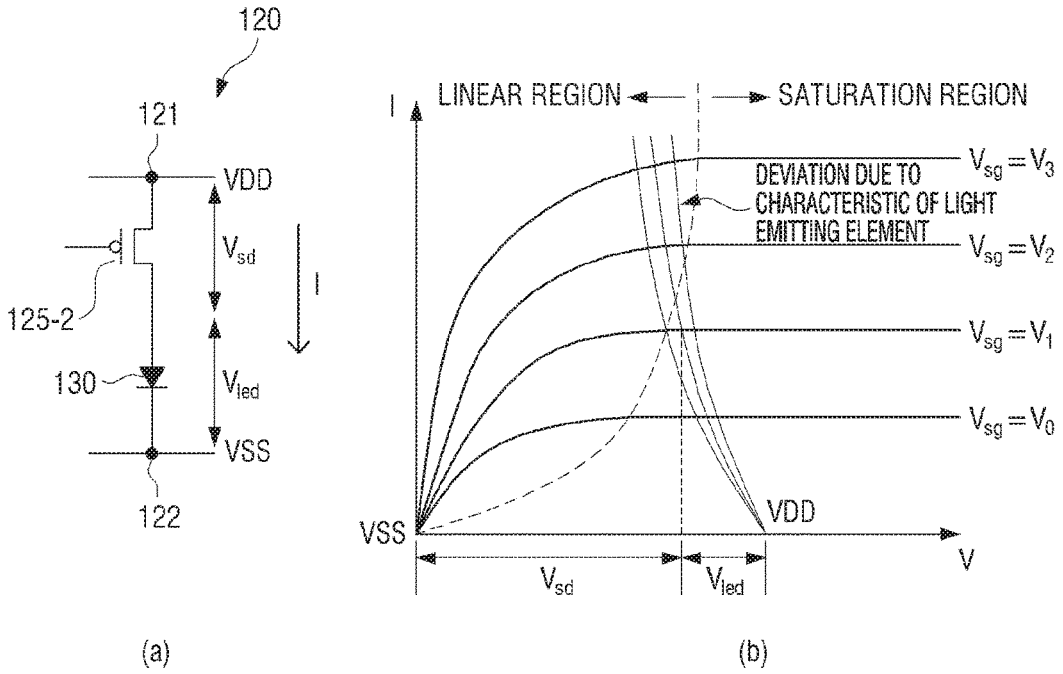

(a) of the FIG. 3B illustrates the current source 120 and the light emitting element 130 of the pixel circuit 100-2 of FIG. 2B. According to an example embodiment, as illustrated in (a) of the FIG. 3B, if the driving transistor is the PMOSFET 125-2, the drain terminal of the PMOSFET 125-2 is connected to an anode terminal of the light emitting element 130, and the source terminal thereof is connected to the drive voltage applying terminal 121. Further, a cathode terminal of the light emitting element 130 is connected to the ground terminal 122. Accordingly, if the PMOSFET 125-2 is turned on in accordance with the gate terminal voltage of the PMOSFET 125-2, the current source 120 may provide the drive current I to the light emitting element 130.

On the other hand, (b) of the FIG. 3B is a graph illustrating the voltage-current characteristic of the PMOSFET 125-2. In (b) of the FIG. 3B, the horizontal axis represents a source-drain voltage Vsd of the PMOSFET 125-2, and the vertical axis represents the current I that flows from the source terminal to the drain terminal of the PMOSFET 125-2 in accordance with Vsd.

As illustrated in (b) of the FIG. 3B, if the gate-source voltage Vgs of the PMOSFET 125-2 (accurately, an absolute value of the threshold voltage since the PMOSFET 125-2 has a negative threshold voltage based on the gate-source voltage Vgs) is equal to or higher than the threshold voltage, much more current I flows as the source-gate voltage Vsg becomes higher (i.e., goes from V0 to V3). Accordingly, the current source 120 may provide the drive current having the different amplitude to the light emitting element 130 in accordance with the level of the voltage applied to the gate terminal of the driving transistor 125-2.

Further, the PMOSFET 125-2 may operate in a linear region or in a saturation region in accordance with the source-drain voltage Vsd for each source-gate voltage Vsg that is equal to or higher than the threshold voltage. Here, the linear region is a region in which the current I flowing from the source terminal to the drain terminal becomes larger as the source-drain voltage Vsd becomes higher, and the saturation region is an operation region in which the current I flowing from the source terminal to the drain terminal becomes constant regardless of the change of the source-drain voltage Vsd. That is, as illustrated in FIG. 3B(B), the PMOSFET 125-2 has the linear region and the saturation region in the case where Vsg is V0 to V3.

On the other hand, the drive voltage VDD applied to the drive voltage terminal 121 is divided into Vled and Vds as illustrated in (a) of the FIG. 3B between the PMOSFET 125-2 and the light emitting element 130. Here, Vsd is a source-drain voltage of the PMOSFET 125-2, and Vled is a forward voltage Vf of the light emitting element 130, that is, a voltage that is required for the light emitting element 130 to emit light.

As illustrated in (b) of the FIG. 3B, the forward voltage Vf of the light emitting element may have a deviation for each light emitting element, and in the case where the light emitting element operates in the linear region of the driving transistor 125-2, voltage division between Vled and Vsd differs due to such a deviation, and thus the drive current I differs to cause luminance deviation between the light emitting elements to occur even with respect to the same drive voltage VDD.

However, according to an example embodiment, in the same manner as described above with reference to FIG. 3A, the operating point of the driving transistor 125-2 can be set through the amplitude setting circuit 110, and thus it is possible to operate the light emitting element 130 in the saturation region of the driving transistor 125-2. That is, according to an example embodiment, the pixel circuit 100-1 applies V0 or V3 as the Vsg value through the amplitude setting circuit 110 in a situation as shown in (b) of the FIG. 3B, and thus it can make the light emitting element 130 operate in the saturation region of the PMOSFET 125-2. Accordingly, the light emitting element 130 can emit light with a constant luminance value regardless of the deviation Vf between the light emitting elements. On the other hand, according to an example embodiment, it may also be possible to make the light emitting element 130 operate in the saturation region of the PMOSFET 125-2 by designing that high drive voltage VDD is applied to the current source 120.

Although it is exemplified that the amplitude setting circuit 110 makes the driving transistor 125-1 or 125-2 operate in the saturation region as described above, the operating point of the driving transistor 125-1 or 125-2 that can be set by the amplitude setting circuit 110 is not limited thereto, and it is also possible to set the voltage applied to the gate terminal of the driving transistor 125-1 or 125-2 so that the driving transistor 125-1 or 125-2 operates in the linear region according to an example embodiment.

Hereinafter, referring to FIGS. 4A to 4D, the detailed configuration and operation of the pixel circuit 100-1 according to an example embodiment will be described. In explaining FIGS. 4A to 4D, explanation of the duplicate contents as described above will be omitted.

Figure 4A:
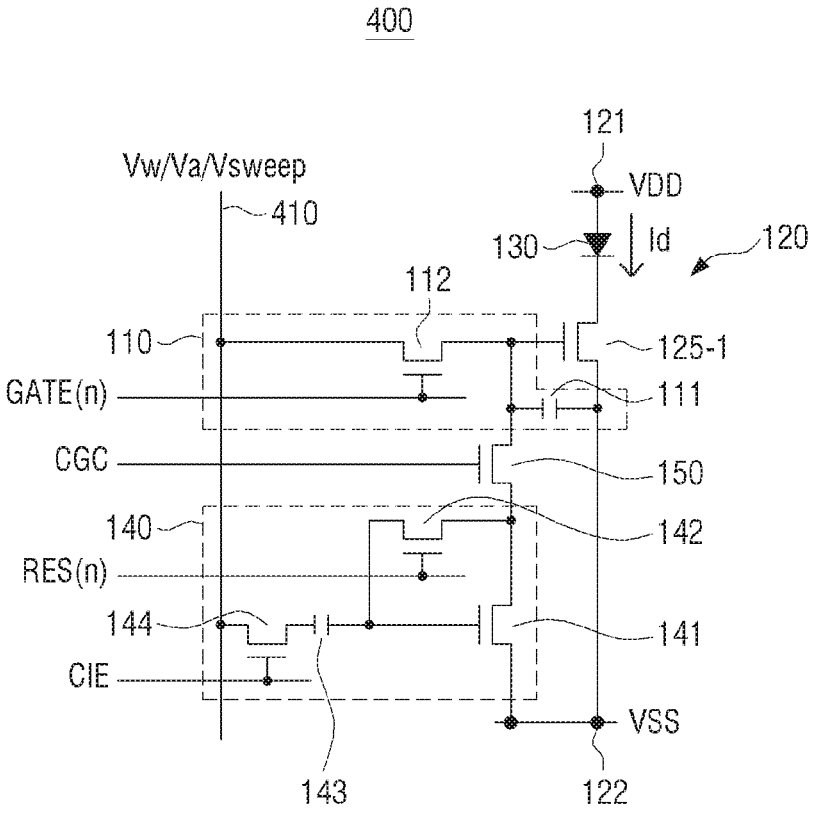
FIG. 4A is a circuit diagram illustrating the detailed configuration of a pixel circuit according to an example embodiment.

FIG. 4A is a circuit diagram illustrating the detailed configuration of a pixel circuit 400 according to an example embodiment. Referring to FIG. 4A, a pixel circuit 400 includes an amplitude setting circuit 110, a current source 120 including a driving transistor 125-1, a light emitting element 130, a pulse width control circuit 140, and a transistor 150. According to an example embodiment, as illustrated in FIG. 4A, all transistors included in the pixel circuit 400 may be NMOSFETs, but are not limited thereto.

The amplitude setting circuit 110 may include a capacitor 111 having one end connected to a source terminal of the driving transistor 125-1 and the other end connected to a gate terminal of the driving transistor 125-1, and a transistor having a source terminal commonly connected to the other end of the capacitor 111 and the gate terminal of the driving transistor 125-1 and a drain terminal through which an amplitude setup voltage Va is input.

Here, the amplitude setup voltage Va is a data signal for setting an amplitude of a drive current Id, and the amplitude setting circuit 110 may receive an input of the amplitude setup voltage Va through the transistor 112 and may charge the capacitor 111 with the input amplitude setup voltage Va in accordance with a control signal GATE(n).

In particular, according to an example embodiment, the amplitude setting circuit 110 of the pixel circuit 400 may charge the capacitor 111 with the amplitude setup voltage Va applied through a data signal line 410 while the transistor 112 is turned on in accordance with the control signal GATE(n) input to the gate terminal of the transistor 112, and may apply the voltage charged in the capacitor 111 to the gate terminal of the driving transistor 125-1.

Accordingly, if a drive voltage VDD is applied to the current source 120 in a state where the voltage charged in the capacitor 111 is applied to the gate terminal of the driving transistor 125-1, the pixel circuit 400 may provide to the light emitting element 130 the drive current Id having an amplitude corresponding to the level of the voltage charged in the capacitor 111.

The transistor 150 may be turned on/off in accordance with a control signal CGC to electrically connect/disconnect the amplitude setting circuit 110 and the pulse width control circuit 140 to/from each other. Referring to FIG. 4A, the transistor 150 may have a drain terminal commonly connected to the other end of the capacitor 111, the gate terminal of the driving transistor 125-1, and the source terminal of the transistor 112, a source terminal commonly connected to a drain terminal of a transistor 141 and a source terminal of a transistor 142, and a gate terminal through which the control signal CGC is input.

Hereinafter, the configuration of the pulse width control circuit 140 will be described on the assumption that the transistor 150 is turned on to operate as a conductive line.

The pulse width control circuit 140 includes an inverter having an output end connected to the gate terminal of the driving transistor 125-1. Here, the inverter is a circuit configuration of which an input is logically inverted to become an output, and an NMOSFET or a PMOSFET may be an inverter in accordance with connection relations in the circuit.

In FIG. 4A, the transistor 141 becomes the inverter. Specifically, in FIG. 4A, the source terminal of the transistor 141 is connected to a ground terminal 122, and if a logical value 0 is applied to the gate terminal of the transistor 141, the transistor 141 is turned off, and the drain terminal thereof has a logical value 1 (voltage applied to the gate terminal of the driving transistor 125-1). If a logical value 1 is applied to the gate terminal of the transistor 141, the transistor 141 is turned on, and the drain terminal thereof has a logical value 0 (ground voltage VSS). Accordingly, the transistor 141 in FIG. 4A may be considered as an inverter having the drain terminal as an output end and the gate terminal as an input end.

In this case, referring to FIG. 4A, the drain terminal of the transistor 141 is connected to the gate terminal of the driving transistor 125-1, the gate terminal thereof is connected to one end of the capacitor 143, and the source terminal thereof is connected to ground.

On the other hand, the pulse width control circuit 140 may include a switching element connected between the input end and the output end of the inverter, and a capacitor 143 having one end connected to the input end of the inverter.

Here, the switching element is configured to be turned on/off in accordance with a control signal, and in FIG. 4A, a transistor 142 may be a switching element that is turned on/off in accordance with a control signal RES(n). Specifically, the transistor 142 has a drain terminal commonly connected to the input end of the inverter (i.e., gate terminal of the transistor 141) and one end of the capacitor 143, a source terminal commonly connected to the output end of the inverter (i.e., drain terminal of the transistor 141) and the gate terminal of the driving transistor 125-1, and a gate terminal through which the control signal RES(n) is input.

On the other hand, the capacitor 143 has one end connected to the input end of the inverter (i.e., gate terminal of the transistor 141) and the drain terminal of the transistor 142, and the other end through which a pulse width setup voltage Vw and a linearly changed voltage Vsweep are input.

In this case, according to an example embodiment of FIG. 4A, the pulse width setting circuit 140 may further include a transistor 144 that is turned on/off in accordance with a control signal CIE. In an example embodiment of FIG. 4A, since the pixel circuit 400 receives through one data signal line 410 all of the amplitude setup voltage Va, the pulse width setup voltage Vw, and the linearly changed voltage Vsweep, the transistor 144 is turned on in accordance with the control signal CIE only while the pulse width setup voltage Vw or the linearly changed voltage Vsweep is applied to the line 410, and is turned off in accordance with the control signal CIE while the amplitude setup voltage Va is applied. Accordingly, the pulse width control circuit 140 can receive only the pulse width setup voltage Vw or the linearly changed voltage Vsweep input through the capacitor 143.

Here, the pulse width setup voltage Vw is a data signal for setting the pulse width of the drive current Id, and the linearly changed voltage Vsweep is a voltage that is linearly changed to linearly change the voltage applied to the gate terminal of the transistor 141. The detailed contents thereof will be described later.

On the other hand, according to an example embodiment, if a specific voltage applied to the input end of the inverter 141 is linearly changed to reach a predetermined threshold voltage, the output end voltage of the inverter 141 becomes the ground voltage, and thus the pulse width control circuit 140 of the pixel circuit 400 can control the duration of the driving current Id.

That is, as described above, if the voltage (e.g., Va) charged in the capacitor 111 by the operation of the amplitude setting circuit 110 is applied to the gate terminal of the driving transistor 125-1 and the drive voltage VDD is applied through the drive voltage terminal 121, the drive current Id having an amplitude corresponding to the level of the voltage Va charged in the capacitor 111 starts to flow to the light emitting element 130.

The drive current Id as described above flows until the output end voltage of the inverter 141 becomes the ground voltage, and if the output end voltage of the inverter 141 becomes the ground voltage, the gate terminal voltage of the driving transistor 125-1 also becomes the ground voltage (it is assumed that the transistor 150 is in an on state), and thus the driving transistor 125-1 is turned off. That is, the drive current Id may continue from a time when the drive voltage VDD is applied to the current source 120 to a time when the output end voltage of the inverter 141 becomes the ground voltage. The detailed contents thereof will be described later.

As a result, the pixel circuit 400 according to an example embodiment may control the luminance of light emitted by the light emitting element 130 by controlling at least one of the amplitude and the pulse width of the drive current Id provided to the light emitting element 130. Specifically, the pixel circuit 400 may control the luminance of the light emitting element 130 by performing pulse amplitude modulation (PAM) for varying the amplitude of the drive current Id and pulse width modulation (PWM) for varying the pulse width of the drive current Id in accordance with various kinds of control signals and data signals. In this case, the pixel circuit 400 may perform the pulse amplitude modulation (PAM) through the amplitude setting circuit 110 and may perform the pulse width modulation (PWM) through the pulse width control circuit 140.

Hereinafter, the detailed operation of the pixel circuit 400 will be described in detail with reference to FIGS. 4B to 4D.

Figure 4B:
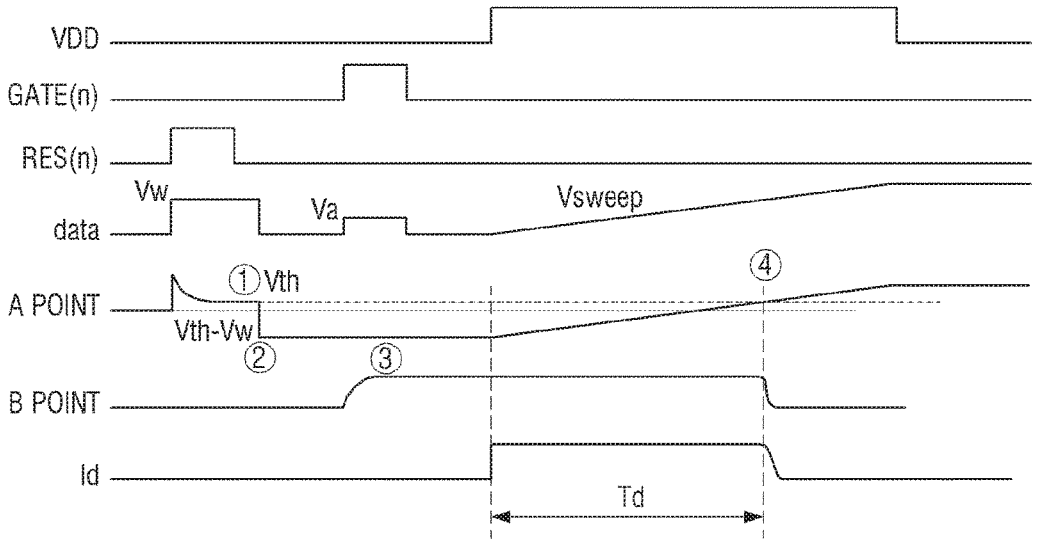
FIGS. 4B and 4C are a timing diagram and circuit diagrams explaining the detailed operation of a pixel circuit according to an example embodiment.
Figure 4C:
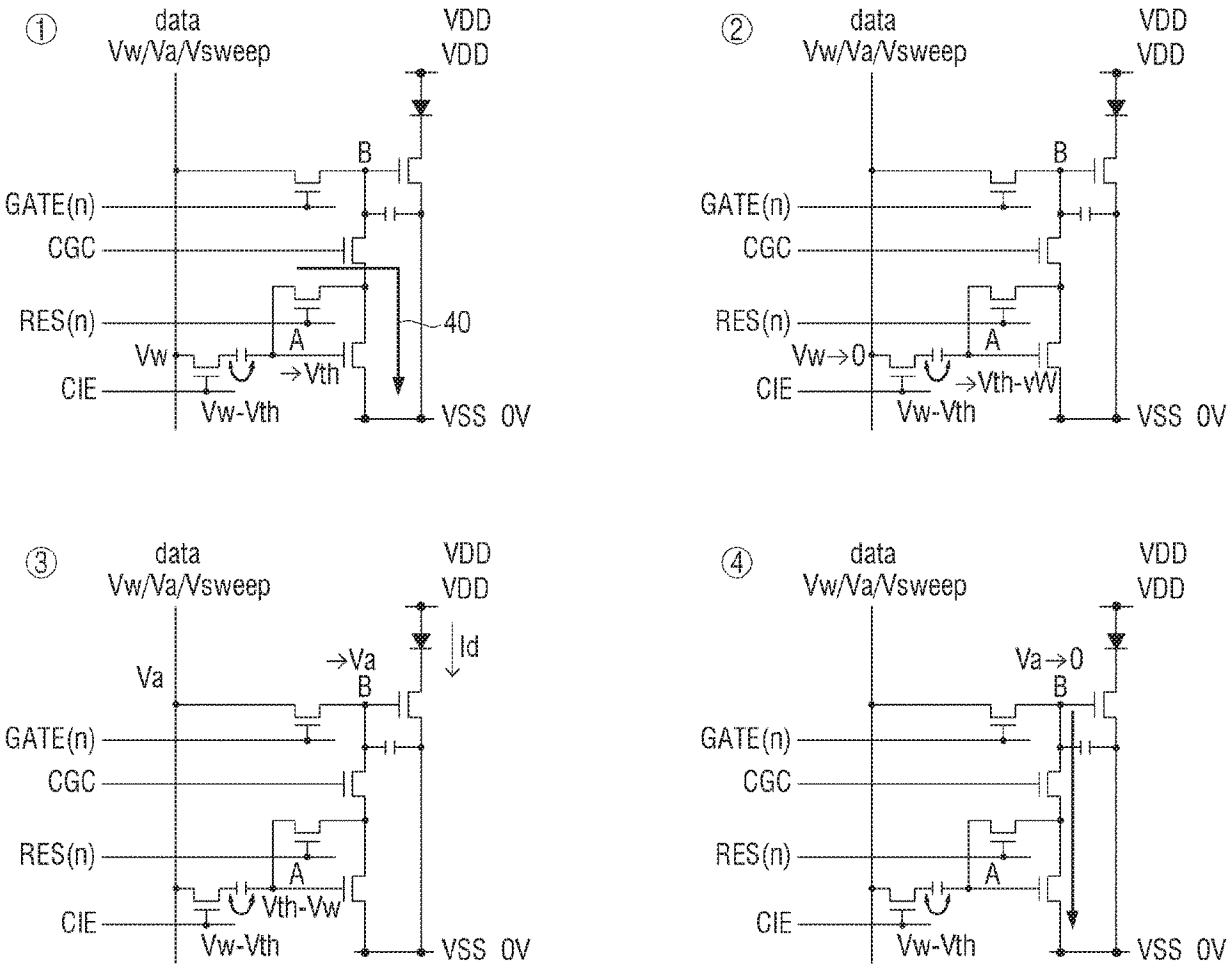

FIGS. 4B and 4C are a timing diagram and circuit diagrams explaining the detailed operation of a pixel circuit 400 according to an example embodiment. Specifically, FIG. 4B illustrates changes of the drive voltage VDD applied to the pixel circuit 400, main control signals GATE(n) and RES(n), data signals Vw, Va, and Vsweep, voltage at the gate terminal (B point) of the driving transistor 125-1, voltage at the input end (A point) of the inverter 141 (i.e., gate terminal of the transistor 141), and drive current Id in accordance with the time. FIG. 4C illustrates the pixel circuit 400 with the lapse of time in the order of ① to ④. ① to ④ of the FIG. 4C correspond to numerals ① to ④ of A point of the graph of FIG. 4B.

As illustrated in FIGS. 4B and 4C, according to an example embodiment, the pixel circuit 400 may set the amplitude and the pulse width of the drive current Id in accordance with control signals and data signals, and if the drive voltage VDD is applied to the current source 120 thereafter, the pixel circuit 400 may provide the drive current Id having the set amplitude and pulse width to the light emitting element 130.

First, as illustrated in FIG. 4B, if the pulse width setup voltage Vw is input to the data signal line 410 and an enable signal (reset signal RES(n)) for turning on the transistor 142 is input to the transistor 142, the voltage of the gate terminal of the transistor 141 (hereinafter referred to as "A point") is set to a predetermined threshold voltage Vth while the reset signal is input. In this case, the pulse width setup voltage Vw may be equal to or higher than the predetermined threshold voltage Vth, and the predetermined threshold voltage Vth may be a threshold voltage of the transistor 141.

Specifically, as Vw is input, the A-point voltage rises from 0 to Vw (in this case, the transistor 144 is turned on in accordance with the control signal CIE, and is maintained in an on state until the input of Vw is completed). In this case, since Vw is higher than Vth, the transistor 141 is in an on state. On the other hand, if a reset signal is input while Vw is applied to A point, the transistor 142 is turned on, and as illustrated in ① of the FIG. 4C, current 40 flows from A point to the ground terminal 122 through the transistor 142 to decrease the voltage of A point. If the A-point voltage is dropped below Vth, the transistor 141 is turned off, and thus the A-point voltage is dropped from Vw to Vth only. In this case, as the A-point voltage approaches Vth, the current 40 flowing to the ground terminal 122 is reduced, and as illustrated in the graph for A point of FIG. 4B, the A-point voltage is slowly decreased to Vth with the lapse of time. Accordingly, the A-point voltage is set to Vth before the input of the reset signal is completed.

On the other hand, although FIG. 4B illustrates that Vw and the reset signal are simultaneously input, the A-point voltage starts to be dropped from the time when the reset signal is input, and thus it may help if the time when Vw is input somewhat precedes the time when the reset signal is input, but is not limited thereto.

Further, although it is exemplified that the A-point voltage is 0 before Vw is input, but is not limited thereto. According to an example embodiment, a certain voltage may be applied to A point before Vw is input. In this case, as Vw is input, the A-point voltage further rises as much as Vw from the certain voltage, and even in this case, the A-point voltage is dropped to Vth before the input of the reset signal is completed.

Referring to FIG. 4B, even after the A-point voltage is set to Vth through completion of the input of the reset signal, the input of Vw is maintained for a predetermined time. Accordingly, as illustrated in ① of the FIG. 4C, the voltage as much as Vw-Vth is maintained between both ends of the capacitor 143 from the time when the A-point voltage is set to Vth.

On the other hand, referring to FIG. 4B, the input of the reset signal is completed, and after the predetermined time, Vw becomes 0 to complete the input of Vw. In this case, since the voltage of Vw-Vth is maintained between the both ends of the capacitor 143, the A-point voltage is dropped as much as Vw from the set Vth to become Vth-Vw as illustrated in ② of the FIG. 4C.

As described above, if the A-point voltage becomes Vth-Vw, the pulse width setup is completed, and thereafter, the A-point voltage Vth-Vw is maintained until the linearly changed voltage is applied together with the drive voltage VDD.

On the other hand, referring to FIG. 4B, the amplitude of the drive current is set after the pulse width setup of the drive current is completed as described above. Specifically, according to an example embodiment, the amplitude setting circuit 110 may charges the capacitor 111 with the amplitude setup voltage Va while the transistor 112 is turned on in accordance with the gate signal GATE(n) input to the gate terminal of the transistor 112, and may apply the voltage charged in the capacitor 111 to the gate terminal of the driving transistor 125-1.

That is, as illustrated in FIG. 4B, if Va is input to the data signal line 410 and the enable signal (gate signal GATE(n)) for turning on the transistor 112 is input to the transistor 112, Va is charged in the capacitor 111 while the transistor 112 is turned on. In this case, the transistor 144 is turned off in accordance with the control signal CIE so that Va is not applied to the pulse width control circuit 140 while Va is applied. Accordingly, Va is applied to the gate terminal of the transistor 125-1 (hereinafter referred to as "B point"), and if the B-point voltage becomes Va, the pulse width setup is completed.

On the other hand, if the drive voltage VDD is applied to the drive voltage terminal 121 of the current source 120 in a state where the voltage charged in the capacitor 111 is applied to the gate terminal of the driving transistor 125-1, the drive current Id having the amplitude corresponding to the voltage applied to the gate terminal of the driving transistor 125-1 flows to the light emitting element 130.

③ of the FIG. 4C illustrates that the transistor 112 is turned on in accordance with the gate signal to charge the capacitor with the amplitude setup voltage, and thereafter, the drive voltage VDD is applied to the current source 120 to cause the drive current Id having the amplitude corresponding to the amplitude setup voltage to start flowing to the light emitting element 130.

On the other hand, according to an example embodiment, the drive current Id is provided to the light emitting element 130 through applying of the drive voltage VDD to the current source 120, and the linearly changed voltage Vsweep is applied to the amplitude setting circuit 140 at the same time.

Specifically, as illustrated in FIG. 4B, the drive voltage VDD is applied to the current source 120, and the linearly changed voltage Vsweep is applied to the data signal line 410 at the same time. In this case, the transistor 144 is turned on in accordance with the control signal CIE to apply Vsweep to the amplitude setting circuit 140.

The voltage as much as Vw-Vth is maintained at both ends of the capacitor 143, and if the linearly changed voltage Vsweep is applied to one end of the capacitor 143, the voltage of the other end of the capacitor 143, that is, A point, is changed with the same slope as the linearly changed slope of Vsweep from the starting point of Vth-Vw.

Since the transistor 141 is in an off state until the A-point voltage reaches Vth according to the change, the voltage Va charged in the capacitor 111 is continuously applied to the B point to maintain the drive current Id.

However, if the A-point voltage is changed to reach Vth in accordance with the linearly changed voltage Vsweep, the transistor 141 is turned on, and in this case, since the source terminal of the transistor 141 is connected to the ground terminal 122, the drain terminal voltage of the transistor 141 and the B-point voltage also become the ground voltage VSS when the transistor 141 is turned on.

As described above, the B point is the gate terminal of the driving transistor 125-1 included in the current source 120, and the source terminal of the driving transistor 125-1 is connected to the ground terminal 122. Accordingly, if the B-point voltage becomes the ground voltage VSS, the gate-source voltage difference of the driving transistor 125-1 becomes 0, and even if the drive voltage VDD is applied to the drain terminal of the driving transistor 125-1, the driving transistor 125-1 is in an off state, and thus the drive current Id does not flow to the light emitting element 130 any further.

④ of the FIG. 4C illustrates a situation in which as the linearly changed voltage is applied to the pulse width control circuit 140, the A-point voltage reaches the threshold voltage Vth of the transistor 141 to make the B-point voltage reach the ground voltage, and thus the drive current Id is interrupted in a state where the drive voltage VDD is applied to the current source 120.

Referring to FIG. 4B, the drive current Id starts to flow with the amplitude corresponding to the amplitude setup voltage Va from the time when the drive voltage VDD is applied to the current source 120, and if the A-point voltage is linearly increased from Vth-Vw to reach Vth in accordance with the linearly increased voltage Vsweep applied to the pulse width control circuit 140 simultaneously with applying of the drive voltage VDD, the output end voltage of the inverter 141 (or the drain terminal voltage of the transistor 141 or the gate terminal voltage of the driving transistor 125-1) becomes the ground voltage to stop the flow of the drive current Id. As a result, the drive current Id flows from the time when the drive voltage VDD is applied to the time when the output end voltage of the inverter 141 becomes the ground voltage (when the A-point voltage becomes the threshold voltage of the transistor 141).

Through this, it can be expected that the time when the drive current Id is maintained (in other words, the duty ratio of the drive current Id or the pulse width of the drive current Id) is to be changed in accordance with the pulse width setup voltage Vw. In an example of FIG. 4B, it can be expected that as the Vw value becomes larger, the duration of the drive current Id becomes longer, and as the Vw value becomes smaller, the duration of the drive current Id becomes shorter.

Specifically, according to an example embodiment, the variation rate (or slope) of the linearly changing voltage Vsweep is constant regardless of the level of the pulse width setup voltage Vw, and if the Vw value becomes smaller than that of the example illustrated in FIG. 4B, the A-point voltage is dropped less than Vth-Vw as indicated as C of A point of FIG. 4B as the input of Vw is completed. Accordingly, if the linearly increased voltage Vsweep is applied thereafter, the A-point voltage reaches Vth earlier than that in the case of FIG. 4B. This means that the output end voltage of the inverter 141 becomes the ground voltage earlier than that in the case of FIG. 4B, and as a result, the duration of the drive current Id becomes shorter than that in the case of FIG. 4B, the pulse width is reduced, and the duty ratio is lowered.

On the other hand, if the Vw value becomes larger than that in the example illustrated in FIG. 4B, the A-point voltage is dropped less than Vth-Vw as indicated as C of A point of FIG. 4B, and thus if the linearly increased voltage Vsweep is applied thereafter, the A-point voltage reaches Vth later than that in the case of FIG. 4B. This means that the output end voltage of the inverter 141 becomes the ground voltage later than that in the case of FIG. 4B, and as a result, the duration of the drive current Id becomes longer than that in the case of FIG. 4B, the pulse width is increased, and the duty ratio is heightened.

In this case, if it is assumed that the slope, that is, the increment rate, of the linearly increased voltage Vsweep is, for example, S [volt/sec] in FIG. 4B, the duration Td of the drive current Id will be {Vth−(Vth-Vw)}/S [sec] or Vw/S [sec].

Figure 4D:
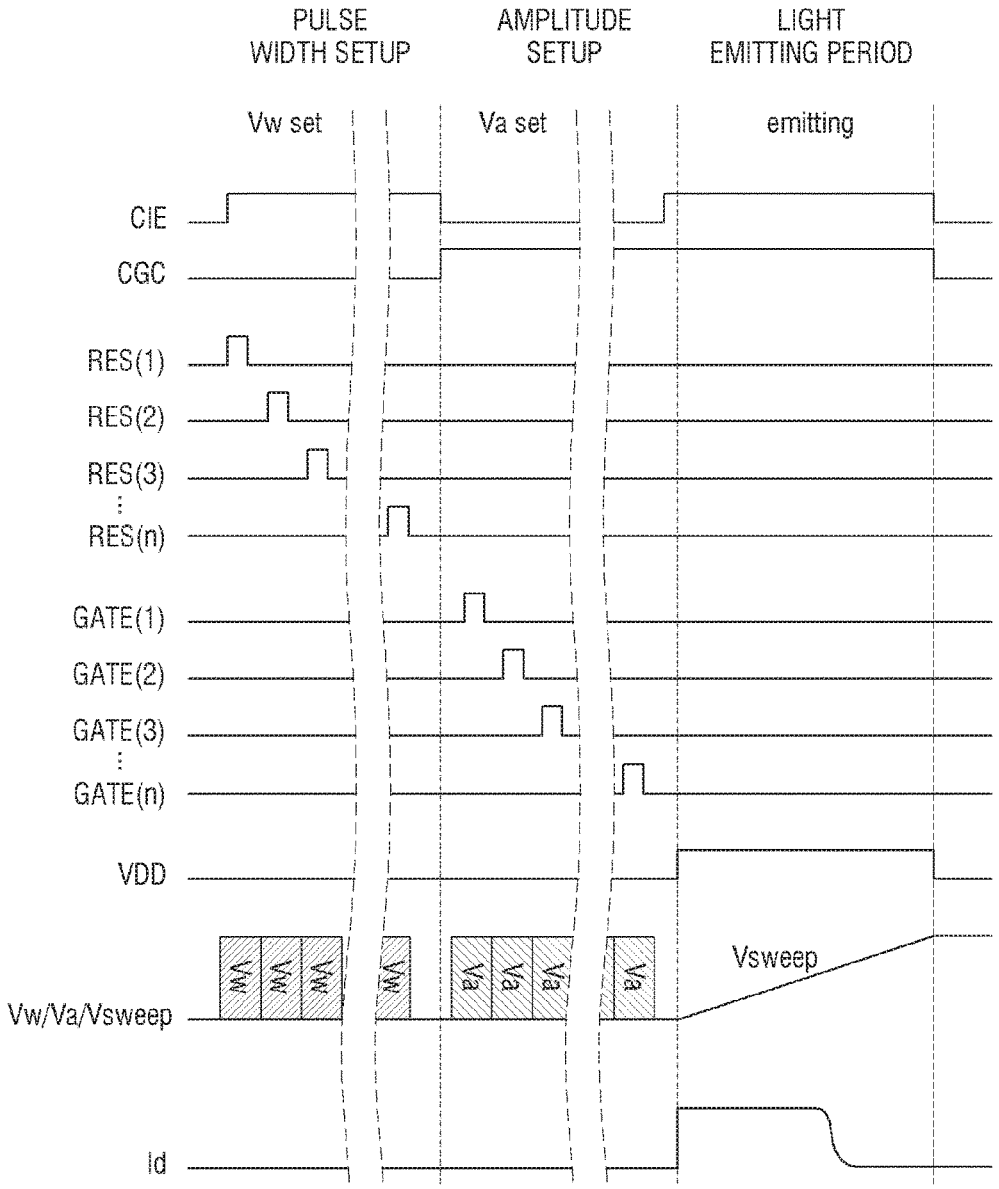
FIG. 4D is a timing diagram of various kinds of data signals and control signals input to a display panel including the pixel circuit of FIG. 4A.

FIG. 4D is a timing diagram of various kinds of data signals and control signals input to a display panel 500 including the pixel circuit 400 of FIG. 4A. As described above, the pixel circuit 400 constitutes each pixel of the display panel 500, and may be driven through a panel driver 200 driving the display panel 500 (see FIG. 11). FIG. 4D illustrates a period in which one image frame is displayed with respect to all pixel circuits 400 constituting the display panel 500 by setting the amplitude and the pulse width of the drive current Id and providing the drive current Id corresponding to the set amplitude and pulse width to a light emitting element 130.

Specifically, FIG. 4D illustrates by sections the driving timing of various kinds of control signals CIE, CGC, RES (n), and GATE(n) and data signals Va, Vw, and Vsweep that the panel driver 200 provides to the respective pixel circuits of the display panel 500 in one period. The detailed contents of the panel driver 200 will be described later with reference to FIG. 11, and hereinafter, the timing of various kinds of data signals and control signals provided by the panel driver 200 will be described. In this case, explanation will be made on the assumption that the display panel 500 includes pixel circuits arranged in the form of a matrix having n rows and m columns.

Referring to FIG. 4D, the control signal CIE controls the on/off operation of the transistor 144 included in each pixel circuit of the display panel 500. As described above, when the data signals Va, Vw, and Vsweep are applied to the pixel circuit 400 through one data signal line 410, the transistor 144 operates to apply only the data signals required for the operation of the pulse width control circuit 140 to the pulse width control circuit 140.

Specifically, since the data signals required for the operation of the pulse width control circuit 140 are the pulse width setup voltage Vw and the linearly changed voltage Vsweep, the control signal CIE, as illustrated in FIG. 4D, may make Vw and Vsweep applied to the pulse width control circuit 140 by turning on the transistor 144 only in sections in which Vw and Vsweep are applied to the data signal line 410, that is, only in the pulse width setup section and in the light emitting section, in the driving period of the display panel 500.

On the other hand, in the amplitude setup period in which Va is applied to the data signal line 410, the control signal CIE turns off the transistor 144 to prevent Va from being input to the pulse width control circuit 140. In the amplitude setup section, as illustrated in FIG. 4D, the transistor 112 of the amplitude setting circuit 110 is turned on in accordance with a control signal Gate(n) to cause the amplitude setup voltage Va to be input and charged in the capacitor 111.

The control signal CGC controls the on/off of the transistor 150 included in each pixel circuit of the display panel 500. As described above, the transistor 150 serves to electrically connect/disconnect the amplitude setting circuit 110 and the pulse width control circuit 140 to/from each other. In the pulse width setup section in which the pulse width of the drive current Id is set, the pulse width setting circuit 140 that performs the above-described operation should not be connected to the amplitude setting circuit 110 or the gate terminal of the driving transistor 125-1. Accordingly, as illustrated in FIG. 4D, the control signal CGC turns off the transistor 150 in the pulse width setup section.

On the other hand, the pulse width control circuit 140 controls the hold time of the drive current Id, and when the drive current Id starts to flow in accordance with applying of the drive voltage VDD, it should be connected to the gate terminal of the driving transistor 125-1. Accordingly, as illustrated in FIG. 4D, the control signal CGC turns on the transistor 150 during the light emitting period. On the other hand, FIG. 4 exemplarily illustrates that the control signal CGC turns on the transistor 150 just after the pulse width setup period, but is not limited thereto. The transistor 150 may be turned on only in the light emitting period.

The control signals RES(1) to RES(n) are control signals successively provided to n rows in the display panel 500 having the pixel circuits arranged by n rows and m columns, and make a specific voltage (i.e., threshold voltage Vth of the transistor 141) input to the input terminal of the inverter by making the input/output terminals of the inverter (i.e., gate and drain terminals of the transistor 141) short-circuited through turn-on of switching elements (i.e., transistors 142) of the respective pulse width control circuit 140 included in m pixel circuits while the pulse width setup voltage Vw is applied to m pixel circuits included in the selected row.

The control signals GATE(1) to GATE(n) are also control signals successively provided to n rows in the display panel 500 having the pixel circuits arranged by n rows and m columns, and make the applied amplitude setup voltage charged in the capacitor 111 by turning on the transistors 112 of the amplitude setting circuits 110 included in m pixel circuits while the amplitude setup voltage Va is applied to m pixel circuits included in the selected row.

The amplitude setup voltage Va is a data signal for setting the amplitude of the drive current Id to be provided to the light emitting elements 130 of the plurality of pixel circuits constituting the display panel 500 in order to display the image frame, and the pulse width setup voltage Vw is a data signal for setting the pulse width of the drive current Id to be provided to the light emitting elements 130 of the plurality of pixel circuits constituting the display panel 500 in order to display the image frame. The amplitude setup voltage Va and the pulse width setup voltage Vw may be voltages having different levels in accordance with brightness values of the respective pixels constituting the image frame.

The linearly increasing voltage Vsweep is a voltage that is linearly increased with a predetermined slope, and is simultaneously applied to the pulse width control circuits 140 of the plurality of pixel circuits constituting the display panel 500 during the light emitting period to control the pulse width of the drive current Id to be provided to the light emitting elements 130. The detailed contents in which the pulse width of the drive current Id is controlled through the linearly increased voltage Vsweep are as described above.

The drive voltage VDD is a voltage that is simultaneously applied to the current sources 120 included in the plurality of pixel circuits constituting the display panel 500, and the drive current Id having the set amplitude and pulse width is simultaneously applied to the light emitting elements 130 of the plurality of pixel circuits, so that the light emitting elements 130 emit light with the corresponding luminance to display the image frame.

Referring to FIGS. 4A to 4D, it is exemplified that the pulse width of the drive current Id is first set and then the amplitude thereof is set. However, the pulse width and amplitude setting order is not limited thereto, and according to an example embodiment, it is also possible to set the amplitude first, and then to set the pulse width.

On the other hand, the contents that are consistent with the pixel circuit 400 as described above with reference to FIGS. 4A to 4D may be applied to other example embodiments of the pixel circuit to be described hereinafter as they are. Accordingly, in the following description, explanation will be made around portions that are inconsistent with or different from the pixel circuit 400 as described above with reference to FIGS. 4A to 4D.

Figure 5A:
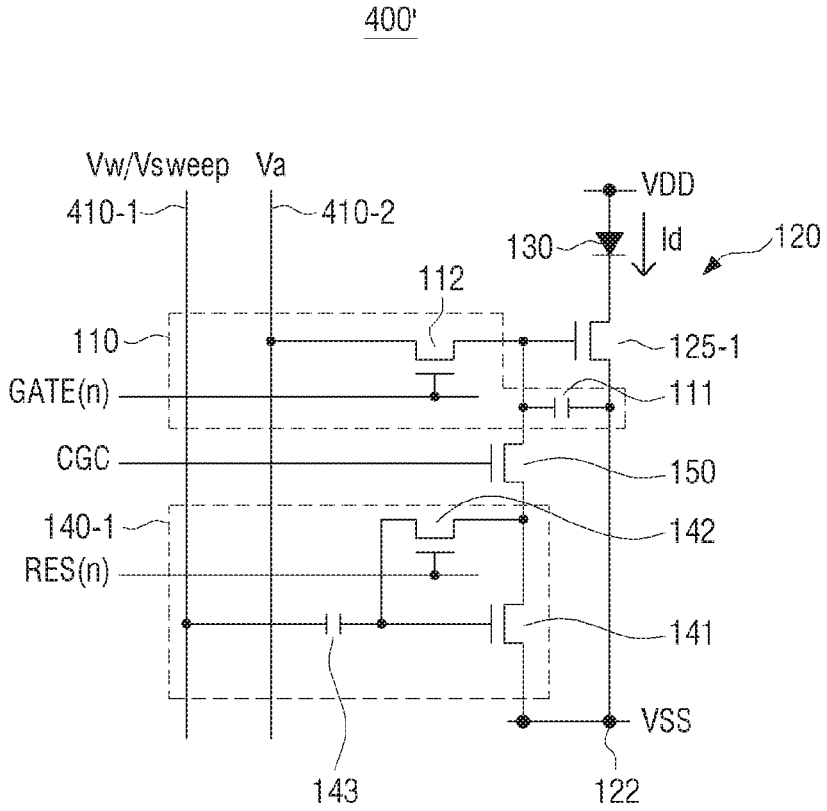
FIG. 5A is a circuit diagram of a pixel circuit according to an example embodiment.

FIG. 5A is a circuit diagram of a pixel circuit 400' according to another example embodiment. As illustrated in FIG. 5A, the pixel circuit 400' has a similar configuration to the configuration of the pixel circuit 400 of FIG. 4A. However, the pixel circuit 400' is different from the pixel circuit 400 on the point that two data signal lines 410-1 and 410-2 are provided, and thus the transistor 144 included in the pulse width control circuit 140 of FIG. 4A is not provided.

According to the pixel circuit 400', different from the pixel circuit 400, the pulse width setup voltage Vw and the linearly increased voltage Vsweep, which are required for the operation of the pulse width setting circuit 140-1, are applied to the pulse width setting circuit 140-1 through one data signal line 410-1, and separately from this, the amplitude setup voltage Va is applied to the amplitude setting circuit 110 through the other data signal line 410-2. Accordingly, like the transistor 144 included in the pulse width control circuit 140 of FIG. 4A, all data signals are applied through one data signal line 410, and thus a configuration for distinguishably receiving an input of the signals is unnecessary. Due to such a difference in configuration with the pixel circuit 400, the pulse width setup and the amplitude setup can be simultaneously performed in the pixel circuit 400'.

Figure 5B:
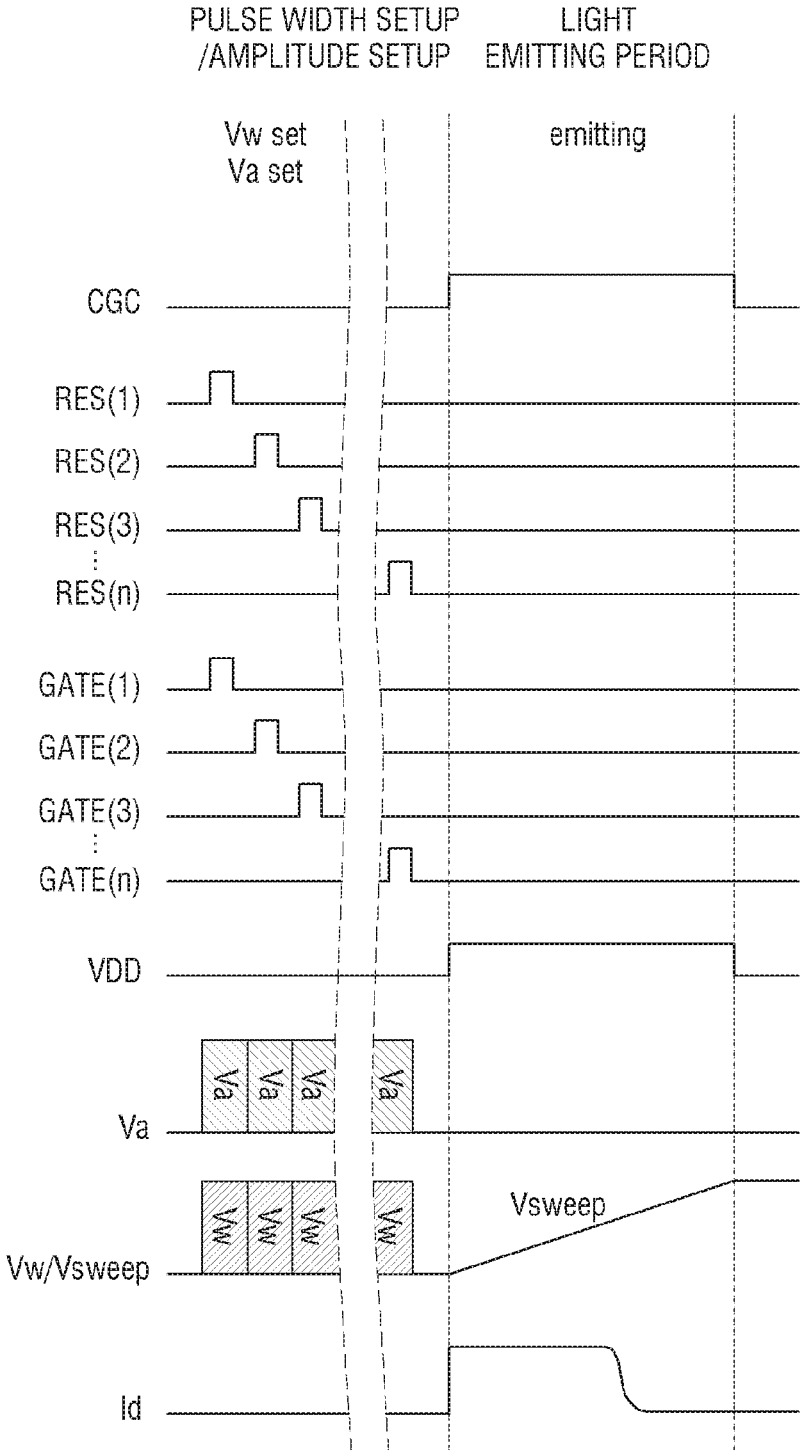
FIG. 5B is a timing diagram of various kinds of data signals and control signals input to a display panel composed of pixel circuits including the pixel circuit of FIG. 5A according to an example embodiment.

FIG. 5B is a timing diagram of various kinds of data signals and control signals input to a display panel 500 composed of pixel circuits including the pixel circuit 400' of FIG. 5A. Referring to FIG. 5B, different from FIG. 4D, it can be seen that the pulse width setup and the amplitude setup of the drive current Id can be simultaneously performed.

Figure 6:
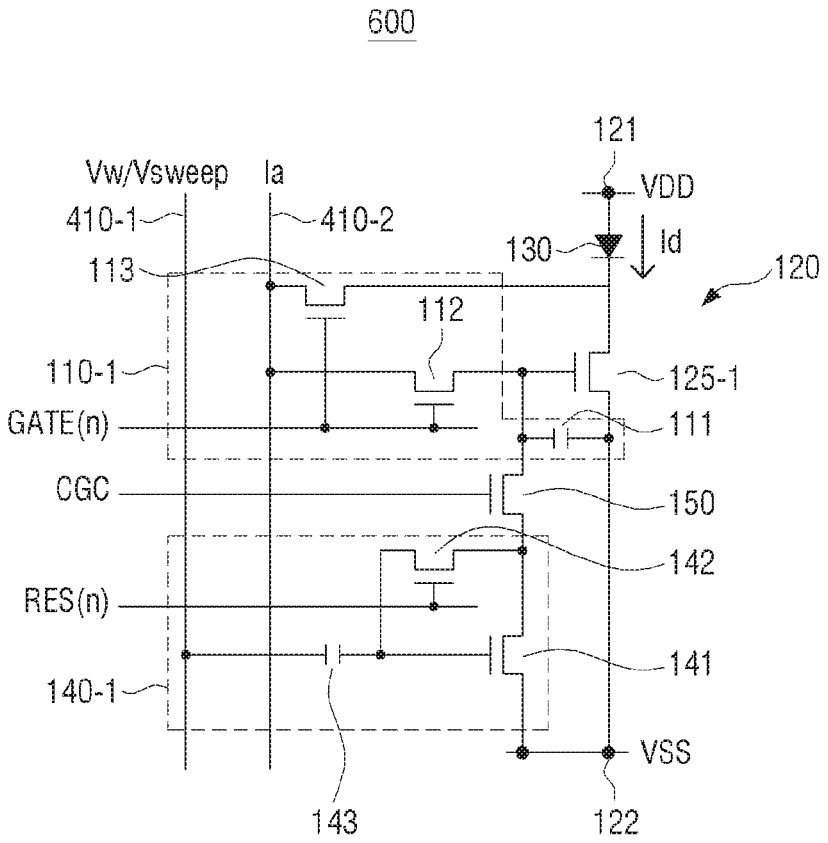
FIG. 6 is a circuit diagram of a pixel circuit according to an example embodiment.

FIG. 6 is a circuit diagram of a pixel circuit according to still another example embodiment. As illustrated in FIG. 6, a pixel circuit 600 has a similar configuration to the configuration of the pixel circuit 400' of FIG. 5A. However, the pixel circuit 600 is different from the pixel circuit 400' on the point that so called a current programming scheme is used for the amplitude setup of the drive current Id.

In performing the amplitude setup of the drive current Id, a voltage programming scheme is a scheme in which the voltage (amplitude setup voltage) Va applied to the gate terminal of the driving transistor 125-1 is directly input through the data signal line and is charged in the capacitor 111, whereas the current programming scheme is a scheme in which in order to charge the capacitor 111 with the voltage (amplitude setup voltage) Va that is applied to the gate terminal of the drive transistor 125-1, current Ia corresponding to the amplitude setup voltage Va flows from the drain terminal to the source terminal of the driving transistor 125-1, and thus the amplitude setup voltage Va that is induced on the gate terminal of the driving transistor 125-1 is charged in the capacitor 111.

For this, in addition to the amplitude setting circuit 110 of the pixel circuit 400' of FIG. 5A, an amplitude setting circuit 110-1 of the pixel circuit 600, as illustrated in FIG. 6, may further include a transistor 113 configured to receive the amplitude setup current Ia input through a data signal line 410-2 and to transfer the received amplitude setup current Ia to the drain terminal of the driving transistor 125-1. In this case, the drain terminal of the transistor 113 is connected to the data signal line 410-2 to receive an input of the amplitude setup current Ia, the source terminal thereof is connected to the drain terminal of the driving transistor 125-1, and the gate terminal thereof is commonly connected to the gate terminal of the transistor 112 to receive an input of a control signal GATE(n).

According to the amplitude setting circuit 110-1 of the pixel circuit 600, the transistor 112 and the transistor 113 are turned on in accordance with the control signal GATE(n) in an amplitude setup section, and thus the amplitude setup current Ia applied to the data signal line 410-2 flows from the drain terminal of the drive current Id to the source terminal. In this case, the voltage applied to the gate terminal of the driving transistor 125-1 is charged in the capacitor 111 to set the amplitude of the drive current Id. Since the operation after the amplitude setup is the same as the operation of the pixel circuit 400 or 400' as described above, duplicate explanation thereof will be omitted.

Figure 7:
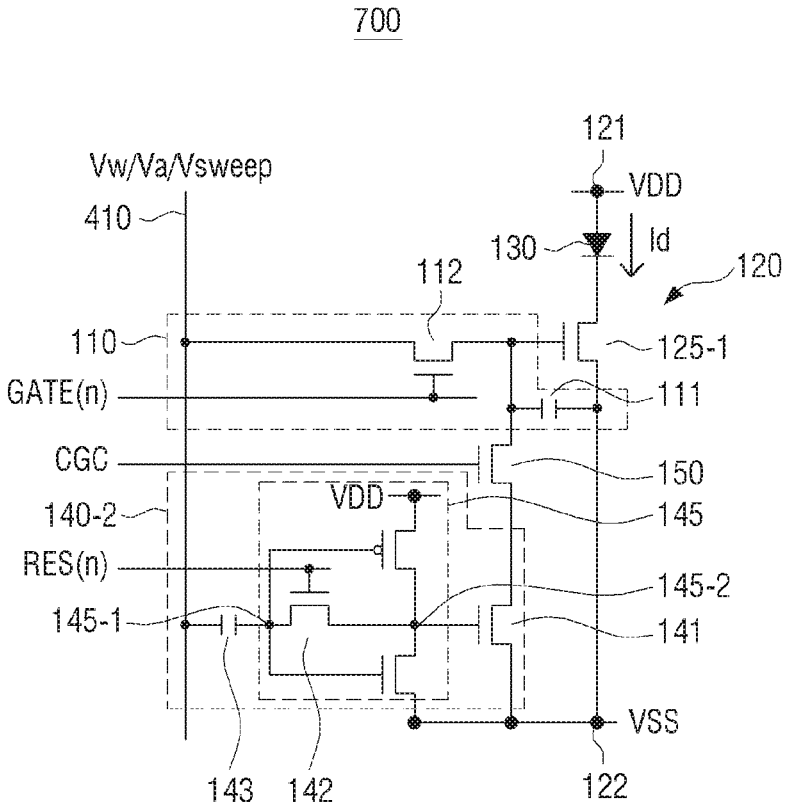
FIG. 7 is a circuit diagram of a pixel circuit according to an example embodiment.

FIG. 7 is a circuit diagram of a pixel circuit according to yet still another example embodiment. A pixel circuit 700 of FIG. 7 has similar configuration and operation to the configuration and operation of the pixel circuit 400 of FIG. 4A. However, the pixel circuit 700 is different from the pixel circuit 400 on the point that a pulse width control circuit 140-2 of the pixel circuit 700 includes another inverter, that is, a complementary metal oxide semiconductor field effect transistor (CMOSFET) inverter 145, in addition to the inverter 141 as described above.

Referring to FIG. 7, the pulse width control circuit 140-2 of the pixel circuit 700 includes an inverter 141 having an output end connected to the gate terminal of the driving transistor 125-1, a CMOSFET inverter 145 having an output end 145-2 connected to an input end of the inverter 141, a capacitor 143 having one end connected to an input end 145-1 of the CMOSFET inverter 145 and the other end to which the pulse width setup voltage Vw and the linearly changed voltage Vsweep are input through the data signal line 410, and a switching element 142 connected between the input end 145-1 and the output end 145-2 of the CMOSFET inverter 145.

Specifically, according to the pulse width control circuit 140-2 of the pixel circuit 700, if a control signal RES(n) is applied to the gate terminal of the switching element 142 to turn on the switching element 142 while the pulse width setup voltage Vw is input to the capacitor 113 through the data signal line 410 in the pulse width setup period, the voltage of the output end 145-2 of the CMOS inverter 145, that is, the voltage of the input end of the inverter 141, is set to a predetermined threshold voltage, that is, a threshold voltage Vth of the inverter 141, while the switching element 142 is turned on.

If the input of the control signal RES(n) is completed, the voltage as much as Vw-Vth is maintained in the capacitor 143, and thus the voltage of the input end of the inverter 141 is dropped from Vth to Vth-Vw simultaneously with completion of the input of the pulse width setup voltage Vw input through the other end of the capacitor 143.

As described above, the pulse width of the drive current Id is set, and then in the light emitting period, as the drive current VDD is applied to the current source 120 and the linearly changed voltage Vsweep is input to the pulse width control circuit 140-2, the drive current ID having the set pulse width is provided to the light emitting element 130. Since the operation of the amplitude setting circuit 110 and the operation of the pulse width control circuit 140-2 after the pulse width setup are the same as those in the pixel circuit 400 or 400' as described above, duplicate explanation thereof will be omitted.

Hereinafter, referring to FIGS. 8A, 8B, and 9, an example embodiment in which all transistors included in the pixel circuit are implemented by PMOSFETs will be described.

Figure 8A:
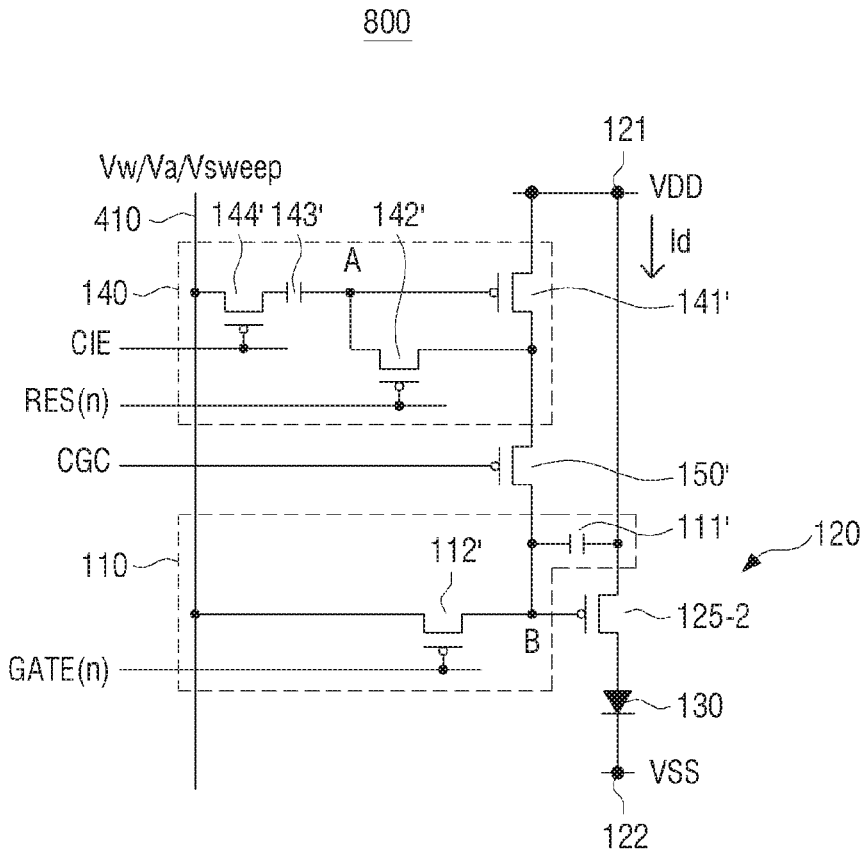
FIGS. 8A, 8B, and 9 are circuit diagrams and a timing diagram explaining various example embodiments in which all transistors included in a pixel circuit are PMOSFETs according to an example embodiment.

FIG. 8A is a circuit diagram illustrating the detailed configuration of a pixel circuit 800 according to an example embodiment. Referring to FIG. 8A, a pixel circuit 800 includes an amplitude setting circuit 110, a current source 120 including a driving transistor 125-2, a light emitting element 130, a pulse width control circuit 140, and a transistor 150'.

The amplitude setting circuit 110 may include a capacitor 111' having one end connected to a source terminal of the driving transistor 125-2 and the other end connected to a gate terminal of the driving transistor 125-2, and a transistor 112' having a drain terminal commonly connected to the other end of the capacitor 111' and the gate terminal of the driving transistor 125-2 and a source terminal through which an amplitude setup voltage Va is input. The amplitude setting circuit 110 may receive an input of the amplitude setup voltage Va and may charge the capacitor 111' with the input amplitude setup voltage Va by turning on the transistor 112' in accordance with a control signal GATE(n).

Specifically, the amplitude setting circuit 110 of the pixel circuit 800 may charge the capacitor 111' with the amplitude setup voltage Va applied through a data signal line 410 while the transistor 112' is turned on in accordance with the control signal GATE(n) input to the gate terminal of the transistor 112', and may apply the voltage charged in the capacitor 111' to the gate terminal of the driving transistor 125-2.

Accordingly, if a drive voltage VDD is applied to the current source 120 in a state where the voltage charged in the capacitor 111' is applied to the gate terminal of the driving transistor 125-2, the pixel circuit 800 may provide to the light emitting element 130 the drive current Id having an amplitude corresponding to the level of the voltage charged in the capacitor 111'.

The transistor 150' may be turned on/off in accordance with a control signal CGC to electrically connect/disconnect the amplitude setting circuit 110 and the pulse width control circuit 140 to/from each other. Referring to FIG. 8A, the transistor 150' may have a drain terminal commonly connected to the other end of the capacitor 111', the gate terminal of the driving transistor 125-2, and the drain terminal of the transistor 112', a source terminal commonly connected to a drain terminal of a transistor 141' and a drain terminal of a transistor 142', and a gate terminal through which the control signal CGC is input. Hereinafter, the configuration of the pulse width control circuit 140 will be described on the assumption that the transistor 150' is turned on to operate as a conductive line.

The pulse width control circuit 140 includes an inverter having an output end connected to the gate terminal of the driving transistor 125-2. In FIG. 8A, the transistor 141' becomes the inverter. Specifically, in FIG. 8A, the source terminal of the transistor 141' that is a PMOSFET is connected to a drive voltage terminal 121, and if a logical value 1 is applied to the gate terminal of the transistor 141', the transistor 141' is turned off, and the drain terminal thereof has a logical value 0. If a logical value 1 is applied to the gate terminal of the transistor 141', the transistor 141' is turned on, and the drain terminal thereof has a logical value 1 (drive voltage VDD). Accordingly, the transistor 141' in FIG. 8A may be considered as an inverter having the drain terminal as an output end and the gate terminal as an input end. In this case, referring to FIG. 8A, the drain terminal of the transistor 141' is connected to the gate terminal of the driving transistor 125-2, the gate terminal thereof is connected to one end of a capacitor 143', and the source terminal thereof is connected to the drive voltage terminal 121 as described above.

On the other hand, the pulse width control circuit 140 may include a switching element connected between the input end and the output end of the inverter, and the capacitor 143' having one end connected to the input end of the inverter. Here, the switching element is configured to be turned on/off in accordance with a control signal, and in FIG. 8A, a transistor 142' may be a switching element that is turned on/off in accordance with a control signal RES(n).

Specifically, the transistor 142' has a source terminal commonly connected to the input end of the inverter (i.e., gate terminal of the transistor 141') and one end of the capacitor 143', a drain terminal commonly connected to the output end of the inverter (i.e., drain terminal of the transistor 141') and the gate terminal of the driving transistor 125-2, and a gate terminal through which the control signal RES(n) is input. The capacitor 143' has one end connected to the input end of the inverter (i.e., gate terminal of the transistor 141') and the source terminal of the transistor 142', and the other end through which a pulse width setup voltage Vw and a linearly changed voltage Vsweep are input.

In this case, according to an example embodiment of FIG. 8A, the pulse width setting circuit 140 may further include a transistor 144' that is turned on/off in accordance with a control signal CIE. In an example embodiment of FIG. 8A, since the pixel circuit 800 receives through one data signal line 410 all of the amplitude setup voltage Va, the pulse width setup voltage Vw, and the linearly changed voltage Vsweep, the transistor 144' is turned on in accordance with the control signal CIE only while the pulse width setup voltage Vw or the linearly changed voltage Vsweep is applied to the line 410, and is turned off in accordance with the control signal CIE while the amplitude setup voltage Va is applied. Accordingly, the pulse width control circuit 140 can receive only the pulse width setup voltage Vw or the linearly changed voltage Vsweep input through the capacitor 143'.

On the other hand, according to an example embodiment, if a specific voltage applied to the input end of the inverter 141' is linearly changed to reach a predetermined threshold voltage, the output end voltage of the inverter 141' becomes the drive voltage VDD of the current source 120, and thus the pulse width control circuit 140 of the pixel circuit 800 can control the duration of the driving current Id.

That is, as described above, if the voltage (e.g., Va) charged in the capacitor 111' by the operation of the amplitude setting circuit 110 is applied to the gate terminal (B point) of the driving transistor 125-2 and the drive voltage VDD is applied through the drive voltage terminal 121, the drive current Id having an amplitude corresponding to the level of the voltage Va charged in the capacitor 111' starts to flow to the light emitting element 130.

The drive current Id as described above flows until the output end voltage of the inverter 141' becomes the drive voltage VDD, and if the output end voltage of the inverter 141' becomes the drive voltage VDD, the gate terminal (B point) voltage of the driving transistor 125-2 also becomes the drive voltage VDD (it is assumed that the transistor 150' is in an on state), and thus the driving transistor 125-2 is turned off. That is, the drive current Id may continue from a time when the drive voltage VDD is applied to the current source 120 to a time when the output end voltage of the inverter 141' becomes the drive voltage VDD.

As described above, the pixel circuit 800 according to an example embodiment may control the luminance of the light emitting element 130 by controlling at least one of the amplitude and the pulse width of the drive current Id provided to the light emitting element 130 (i.e., by performing pulse amplitude modulation (PAM) and pulse width modulation (PWM)) in accordance with the amplitude setup voltage Va and the pulse width setup voltage Vw.

On the other hand, since all transistors included in the pixel circuit 800 are implemented by PMOSFETs, signals having inverted forms of the control signals CIE, CGC, RES(n), and GATE(n) and the data signals Vw, Va, and Vsweep input to the pixel circuit 400 of FIG. 4A, in which all the transistors are implemented by NMOSFETs, are input to the pixel circuit 800.

Figure 8B:
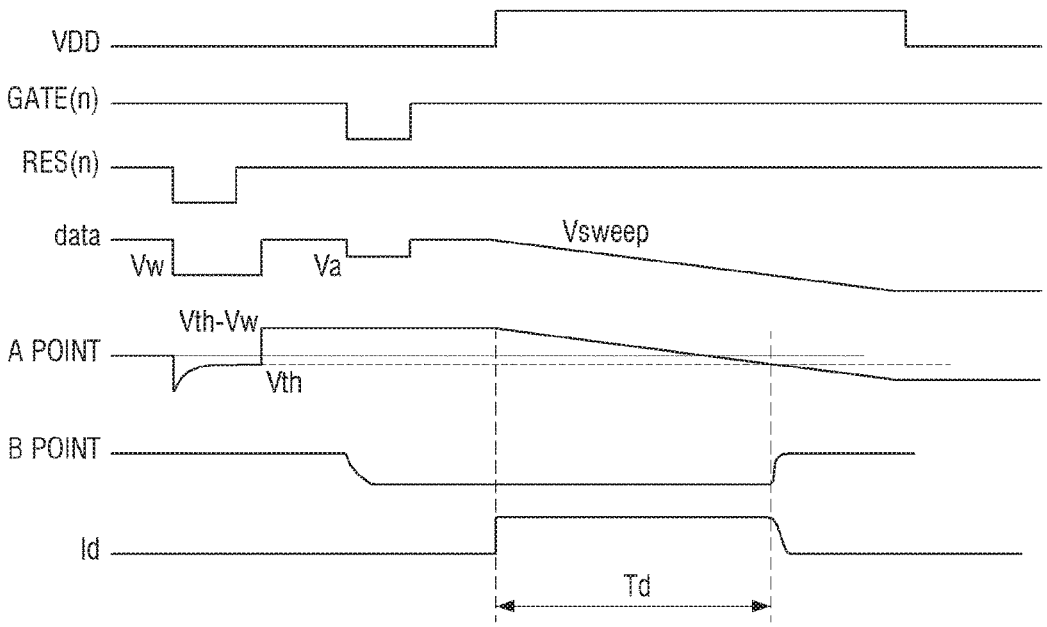

FIG. 8B is a timing diagram explaining the detailed operation of the pixel circuit 800. Specifically, FIG. 8B illustrates changes of the drive voltage VDD applied to the pixel circuit 800, main control signals GATE(n) and RES(n), data signals Vw, Va, and Vsweep, voltage at the gate terminal (B point) of the driving transistor 125-2, voltage at the input end (A point) of the inverter 141' (i.e., gate terminal of the transistor 141'), and drive current Id in accordance with the time.

As illustrated in FIG. 8B, the pixel circuit 800 may set the amplitude and the pulse width of the drive current Id in accordance with control signals and data signals, and thereafter, if the drive voltage VDD is applied to the current source 120, the pixel circuit 800 may provide the drive current Id having the set amplitude and pulse width to the light emitting element 130.

First, as illustrated in FIG. 8B, if the pulse width setup voltage Vw is input to the data signal line 410 and an enable signal (reset signal RES(n)) for turning on the transistor 142' is input to the transistor 142', the voltage of the gate terminal of the transistor 141' (hereinafter referred to as "A point") is set to a predetermined threshold voltage Vth while the reset signal is input. In this case, the predetermined threshold voltage Vth may be a threshold voltage of the transistor 141'.

Specifically, as Vw is input, the A-point voltage is dropped from 0 to Vw (in this case, the transistor 144' is turned on in accordance with the control signal CIE, and is maintained in an on state until the input of Vw is completed). In this case, since Vw is lower than Vth, the transistor 141' is in an on state. On the other hand, if a reset signal is input while Vw is applied to A point, the transistor 142' is turned on, and current flows at A point through the transistor 142' to increase the voltage of A point. If the A-point voltage rises up to Vth, the transistor 141' is turned off, and thus the A-point voltage rises from Vw to Vth only. In this case, as the A-point voltage approaches Vth, the current flowing through the transistor 120' is reduced, and the A-point voltage rises slowly to Vth with the lapse of time. Accordingly, the A-point voltage is set to Vth before the input of the reset signal is completed.

On the other hand, although FIG. 8B illustrates that Vw and the reset signal are simultaneously input, the A-point voltage starts to be dropped from the time when the reset signal is input, and thus it may help if the time when Vw is input somewhat precedes the time when the reset signal is input, but is not limited thereto.

Further, although it is exemplified that the A-point voltage is 0 before Vw is input, but is not limited thereto. According to an example embodiment, a certain voltage may be applied to A point before Vw is input. In this case, as Vw is input, the A-point voltage further rises as much as Vw from the certain voltage, and even in this case, the A-point voltage is dropped to Vth before the input of the reset signal is completed.

Referring to FIG. 8B, even after the A-point voltage is set to Vth through completion of the input of the reset signal, the input of Vw is maintained for a predetermined time. Accordingly, the voltage as much as Vw-Vth is maintained between both ends of the capacitor 143' from the time when the A-point voltage is set to Vth.

On the other hand, referring to FIG. 8B, the input of the reset signal is completed, and after the predetermined time, Vw becomes 0 to complete the input of Vw. In this case, since the voltage of Vw-Vth is maintained between the both ends of the capacitor 143', the A-point voltage is dropped as much as Vw from the set Vth to become Vth-Vw.

As described above, if the A-point voltage becomes Vth-Vw, the pulse width setup is completed, and thereafter, the A-point voltage Vth-Vw is maintained until the linearly changed voltage is applied together with the drive voltage VDD.

On the other hand, referring to FIG. 8B, the amplitude of the drive current is set after the pulse width setup of the drive current is completed as described above. Specifically, according to an example embodiment, the amplitude setting circuit 110 may charges the capacitor 111' with the amplitude setup voltage Va while the transistor 112' is turned on in accordance with the gate signal GATE(n) input to the gate terminal of the transistor 112', and may apply the voltage charged in the capacitor 111' to the gate terminal of the driving transistor 125-2.

That is, as illustrated in FIG. 8B, if Va is input to the data signal line 410 and the enable signal (gate signal GATE(n)) for turning on the transistor 112' is input to the transistor 112', Va is charged in the capacitor 111' while the transistor 112' is turned on. In this case, the transistor 144' is turned off in accordance with the control signal CIE so that Va is not applied to the pulse width control circuit 140 while the Va is applied. Accordingly, Va is applied to the gate terminal of the transistor 125-2 (hereinafter referred to as "B point"), and if the B-point voltage becomes Va, the pulse width setup is completed.

On the other hand, if the drive voltage VDD is applied to the drive voltage terminal 121 of the current source 120 in a state where the voltage charged in the capacitor 111' is applied to the gate terminal of the driving transistor 125-2, the drive current Id having the amplitude corresponding to the voltage applied to the gate terminal of the driving transistor 125-2 flows to the light emitting element 130.

On the other hand, according to an example embodiment, the drive current Id is provided to the light emitting element 130 through applying of the drive voltage VDD to the current source 120, and the linearly changed voltage Vsweep is applied to the amplitude setting circuit 140 at the same time.

Specifically, as illustrated in FIG. 8B, the drive voltage VDD is applied to the current source 120, and the linearly changed voltage Vsweep is applied to the data signal line 410 at the same time. In this case, the transistor 144' is turned on in accordance with the control signal CIE to apply Vsweep to the amplitude setting circuit 140.

The voltage as much as Vw-Vth is maintained at both ends of the capacitor 143', and if the linearly changed voltage Vsweep is applied to one end of the capacitor 143', the voltage of the other end of the capacitor 143', that is, A point, is changed with the same slope as the linearly changed slope of Vsweep from the starting point of Vth-Vw. Since the transistor 141' is in an off state until the A-point voltage reaches Vth according to the change, the voltage Va charged in the capacitor 111' is continuously applied to the B point to maintain the drive current Id.

However, if the A-point voltage is changed to reach Vth in accordance with the linearly changed voltage Vsweep, the transistor 141' is turned on, and in this case, since the source terminal of the transistor 141' is connected to a drive voltage VDD terminal 121, the drain terminal voltage of the transistor 141' and the B-point voltage also become the drive voltage VDD if the transistor 141' is turned on.

As described above, the B point is the gate terminal of the driving transistor 125-2 included in the current source 120, and the source terminal of the driving transistor 125-2 is connected to the drive voltage terminal 121. Accordingly, if the B-point voltage becomes the drive voltage VDD, the gate-source voltage difference of the driving transistor 125-2 becomes 0, and even if the drive voltage VDD is applied to the source terminal of the driving transistor 125-2, the driving transistor 125-2 is in an off state, and thus the drive current Id does not flow to the light emitting element 130 any further.

Referring to FIG. 8B, the drive current Id starts to flow with the amplitude corresponding to the amplitude setup voltage Va from the time when the drive voltage VDD is applied to the current source 120, and if the A-point voltage is linearly decreased from Vth-Vw to reach Vth in accordance with a linearly decreased voltage Vsweep applied to the pulse width control circuit 140 simultaneously with applying of the drive voltage VDD, the output end voltage of the inverter 141' (or the drain terminal voltage of the transistor 141' or the gate terminal voltage of the driving transistor 125-2) becomes the drive voltage VDD to stop the flow of the drive current Id. As a result, the drive current Id flows from the time when the drive voltage VDD is applied to the time when the output end voltage of the inverter 141' becomes the drive voltage VDD (when the A-point voltage becomes the threshold voltage of the transistor 141').

Through this, it can be expected that the time when the drive current Id is maintained (in other words, the duty ratio of the drive current Id or the pulse width of the drive current Id) is to be changed in accordance with the pulse width setup voltage Vw. In an example of FIG. 8B, it can be expected that as the Vw value becomes larger, the duration of the drive current Id becomes longer, and as the Vw value becomes smaller, the duration of the drive current Id becomes shorter.

Specifically, according to an example embodiment, the variation rate (or slope) of the linearly changed voltage Vsweep is constant regardless of the level of the pulse width setup voltage Vw, and if an absolute value of Vw becomes smaller than that of the example illustrated in FIG. 8B, the A-point voltage rises less than Vth-Vw as illustrated in FIG. 8B as the input of Vw is completed. Accordingly, if the linearly decreased voltage Vsweep is applied thereafter, the A-point voltage reaches Vth earlier than that in the case of FIG. 8B. This means that the output end voltage of the inverter 141' becomes the drive voltage VDD earlier than that in the case of FIG. 8B, and as a result, the duration of the drive current Id becomes shorter than that in the case of FIG. 8B, the pulse width is reduced, and the duty ratio is lowered.

On the other hand, if the absolute value of Vw value becomes larger than that in the example illustrated in FIG. 8B, the A-point voltage rises higher than Vth-Vw as illustrated in FIG. 8B, and thus if the linearly decreased voltage Vsweep is applied thereafter, the A-point voltage reaches Vth later than that in the case of FIG. 8B. This means that the output end voltage of the inverter 141' becomes the drive voltage VDD later than that in the case of FIG. 8B, and as a result, the duration of the drive current Id becomes longer than that in the case of FIG. 8B, the pulse width is increased, and the duty ratio is heightened.

In this case, if it is assumed that the slope, that is, the increment rate, of the linearly decreased voltage Vsweep is, for example, S [volt/sec] in FIG. 8B, the duration Td of the drive current Id will be {Vth−(Vth-Vw)}/S [sec] or Vw/S [sec].

Figure 9:
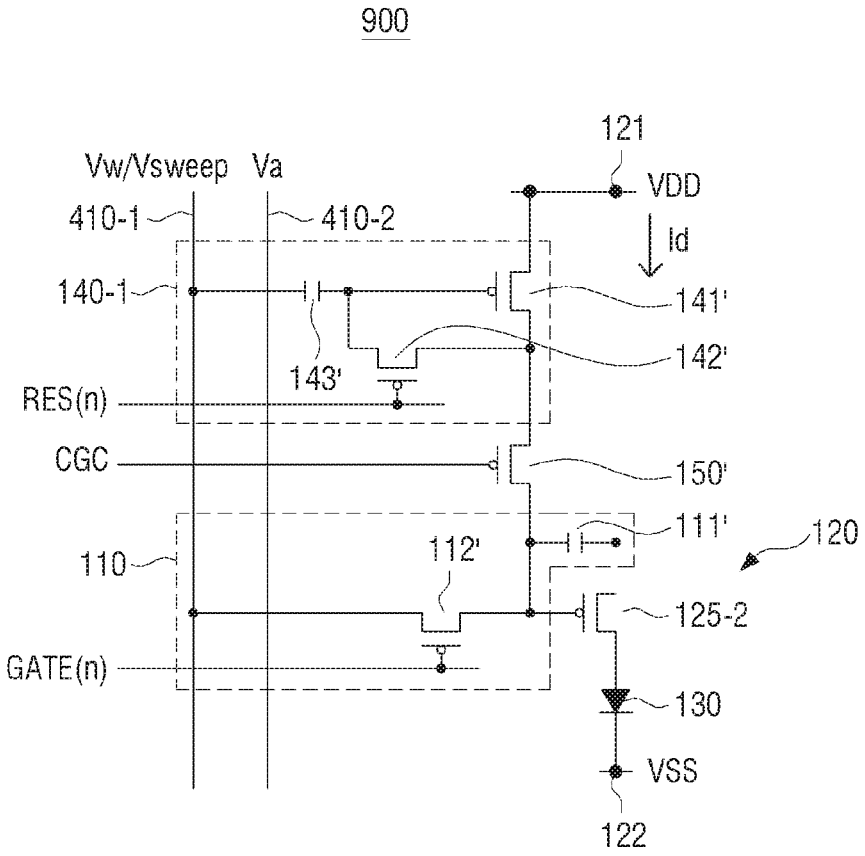

FIG. 9 is a circuit diagram of a pixel circuit 900 according to still another example embodiment. As illustrated in FIG. 9, the pixel circuit 900 has a similar configuration to the configuration of the pixel circuit 800 of FIG. 8A. However, the pixel circuit 900 is different from the pixel circuit 800 on the point that two data signal lines 410-1 and 410-2 are provided, and thus the transistor 144' included in the pulse width control circuit 140 of FIG. 8A is not necessary.

According to the pixel circuit 900, different from the pixel circuit 800, the pulse width setup voltage Vw and the linearly increased voltage Vsweep, which are required for the operation of the pulse width setting circuit 140, are applied to the pulse width setting circuit 140 through one data signal line 410-1, and separately from this, the amplitude setup voltage Va is applied to the amplitude setting circuit 110 through the other data signal line 410-2. Accordingly, like the transistor 144' included in the pulse width control circuit 140 of FIG. 8A, all data signals are applied through one data signal line 410, and thus a configuration for distinguishably receiving an input of the signals is not necessary. Due to such a difference in configuration with the pixel circuit 800, in contrast with that as illustrated in FIG. 8B, the pulse width setup and the amplitude setup can be simultaneously performed in the pixel circuit 900.

On the other hand, like the NMOSFET pixel circuit as described above, the PMOSFET pixel circuit 800 or 900 may adopt a current programming scheme for amplitude setup of the drive current Id.

Figure 10A:
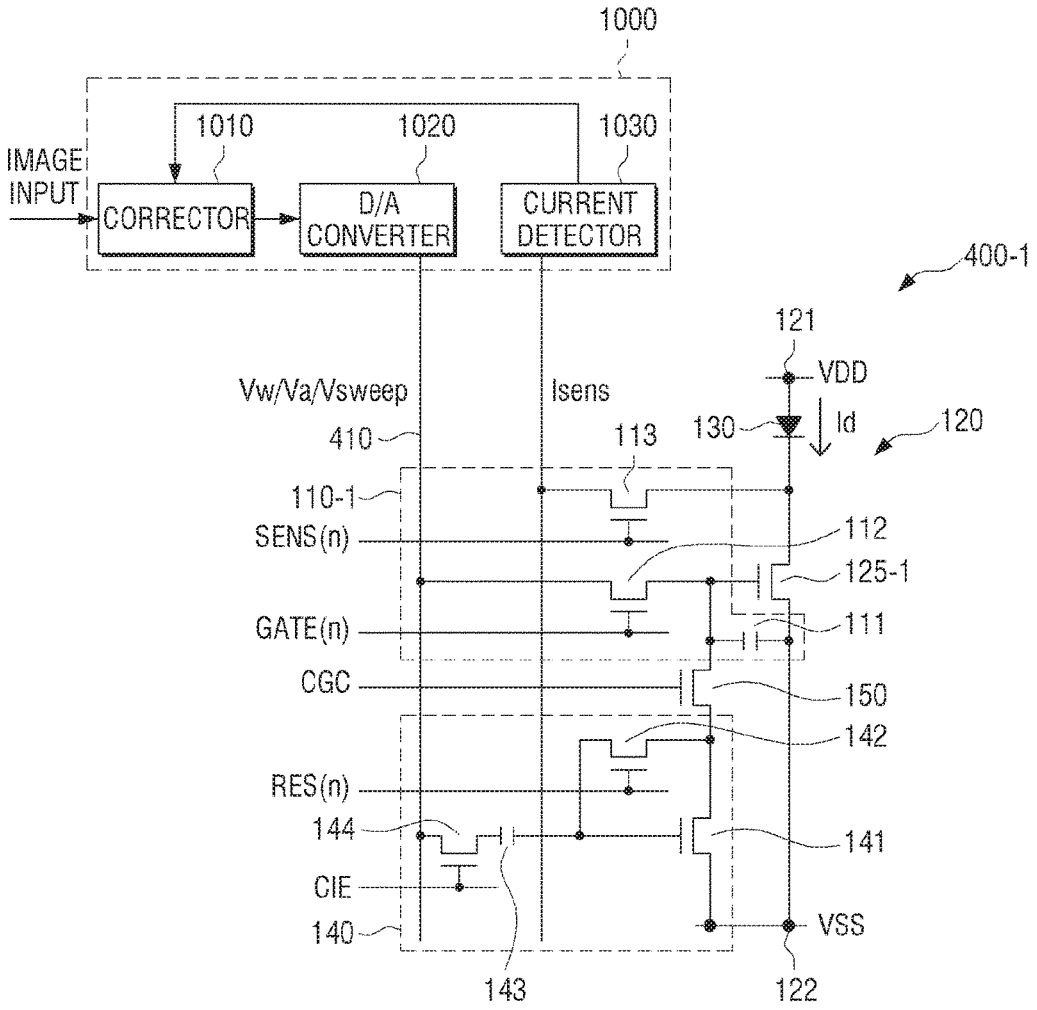
FIGS. 10A and 10B are exemplary diagrams of a pixel circuit to which a compensation circuit is applied according to an example embodiment.
Figure 10B:
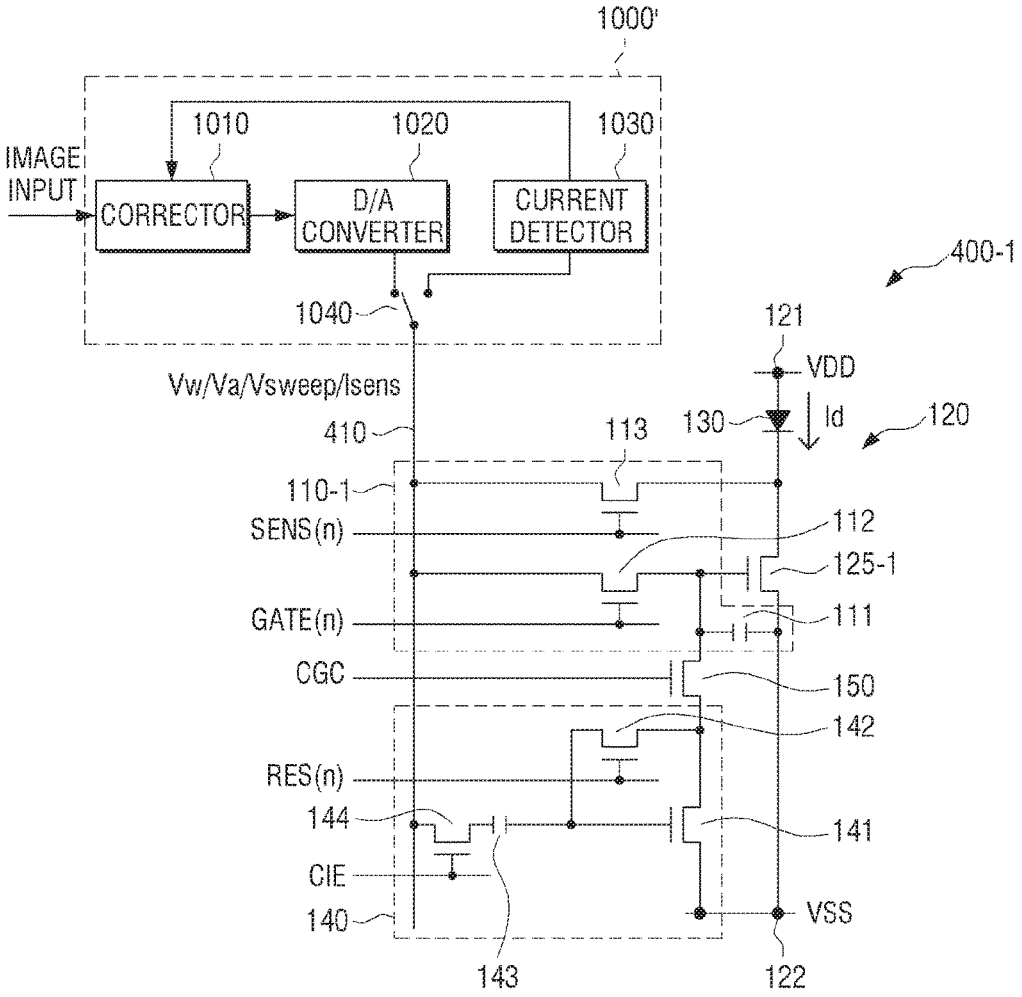

FIGS. 10A and 10B are exemplary diagrams of a pixel circuit 400 to which a compensation circuit is applied according to an example embodiment. In general, even in thin film transistor (TFT) circuits constituting the same display panel, there may exist a deviation in threshold voltage Vth or mobility μ of each transistor included in the TFT circuits. Specifically, in the case of amorphous silicon (a-SI), the threshold voltage Vth of each transistor may be changed with the lapse of time, and in the case of low temperature poly silicon (LTPS), there may exist a difference in threshold voltage Vth or mobility μ between the transistors. Such a difference causes deterioration of luminance uniformity of a display panel, and thus it may be necessary to correct the deviation in threshold voltage Vth and mobility μ between the TFT transistors through a compensation circuit.

FIG. 10A is an exemplary diagram of a pixel circuit 400-1 to which a compensation circuit 1000 is applied according to an example embodiment. Referring to FIG. 10A, the pixel circuit 400-1 includes a current source 120 including a driving transistor 125-1, a light emitting element 130, an amplitude setting circuit 110-1, and a pulse width control circuit 140. In this case, since the pulse width control circuit 140 of the pixel circuit 400-1 has the same configuration and operation as those of the pulse width control circuit 140 of the pixel circuit 400 of FIG. 4A, duplicate explanation thereof will be omitted.

On the other hand, the amplitude setting circuit of the pixel circuit 400-1 has the same configuration as the configuration of the amplitude setting circuit 110-1 of the pixel circuit 600 of FIG. 6, but has different operation and connection to an outside, such as the compensation circuit 1000, and thus explanation will be made around such different points.

In the amplitude setting circuit 110-1 of the pixel circuit 600 of FIG. 6, the drain terminal of the transistor 113 is connected to the data signal line 410-2, and in order to set the amplitude of the drive current Id in the current programming scheme, the transistor 113 is turned on in accordance with the control signal GATE(n) to receive an input of the amplitude setup current Ia.

In contrast, the amplitude setting circuit 110-1 of the pixel circuit 400-1 as illustrated in FIG. 8A operates in the voltage programming scheme for receiving an input of the amplitude setup voltage Va applied to one data signal line 410 through the transistor 112 and applying the input amplitude setup voltage Va to the gate terminal of the driving transistor 125-1, and the transistor 113 is used to detect the driving current Id.

Specifically, the transistor 113 has a drain terminal connected to a current detector 1030 of the compensation circuit 1000, a source terminal connected to the drain terminal of the driving transistor 125-1, and a gate terminal through which a control signal SENS(n) is input. The transistor 113 is turned on in accordance with the control signal SENS(n) input through the gate terminal thereof to enable the current detector 1030 to detect current Isens flowing through the driving transistor 125-1.

More specifically, before the pixel circuit 400-1 starts the amplitude setup and pulse width setup operation to display an image frame, the compensation circuit 1000 applies a specific voltage Vx to the gate terminal of the driving transistor 125-1 through a D/A converter 1020 (in this case, the transistor 112 is turned on in accordance with the control signal GATE(n)), and then detects the current Isens flowing to the driving transistor 125-1 through the current detector 1030 (in this case, the transistor 113 is turned on in accordance with the control signal SENS(n)).

A compensator of the compensation circuit 1000 corrects the input image data using the current value detected through the current detector 1030, and provides corrected data to the D/A converter 1020. The D/A converter 1020 applies the corrected image data to the data signal line 410 in sequence.

The pixel circuit 400-1 performs the pulse width setup and amplitude setup operation in accordance with the corrected Vw or Va, and operates to display the image frame of which the deviation between the transistors is compensated for.

On the other hand, as illustrated in FIG. 10A, the compensation circuit 1000 may include a corrector 1010, a D/A converter 1020, and a current detector 1030.

The corrector 1010 may correct the input image data using the detected current value provided from the current detector 1030. For example, the corrector 1010 may compare data on the current value to flow to the driving transistor 125-1 corresponding to the specific voltage Vx with the current value detected by the current detector 1030, and may correct the image data in accordance with the result of the comparison.

In this case, the data on the current value corresponding to the specific voltage may be stored in various kinds of memories inside or outside the compensation circuit 1000 in the form of a lookup table, and the corrector 1010 may acquire and use the data stored in the memory. However, an example of correction of the image data using the detected current value is not limited thereto.

For this, the corrector 1010 may be implemented by various kinds of processors or field-programmable gate arrays (FPGA), but is not limited thereto.

The D/A converter 1020 may apply the amplitude setup voltage Va and the pulse width setup voltage Vw of the drive current Id corresponding to the image data or the image data corrected by the corrector 1010 to the data signal line 410. Further, for image data correction, the D/A converter 1020 may apply the specific voltage Vx for detecting the current flowing to the driving transistor 125-1 to the data signal line 410. In this case, the operation of the D/A converter 1020 may be controlled by the corrector 1010, but is not limited thereto. The operation of the D/A converter 1020 may also be controlled by an external processor.

The current detector 1030 is connected to the transistor 113 to detect the current flowing to the driving transistor 125-1. For this, the current detector 1030 may be implemented in various manners in accordance with the current detection scheme. For example, in the case of detecting the current by measuring the voltage applied at both ends of a resistor, the current detector 1030 may include the resistor, whereas in the case of detecting the current by measuring the variation rate of the voltage applied at both ends of a capacitor, the current detector 1030 may be implemented to include an operational amplifier (OP-AMP) and the capacitor, but are not limited thereto.

On the other hand, respective configurations of the compensation circuit 1000 as described above may be included in a source driver for driving the display panel, but are not limited thereto. For example, if an external processor performs the operation of the corrector 1010, the D/A converter 1020 and the current detector 1030 are included in the source driver, and the corrector 1010 may be implemented using the external processor.

FIG. 10B is an exemplary diagram of a pixel circuit 400-2 to which a compensation circuit 1000' is applied according to another example embodiment. The pixel circuit 400-2 of FIG. 10B has the same configuration as the configuration of the pixel circuit 400-1 of FIG. 10A. However, the pixel circuit 400-2 may apply various kinds of data signals Vw, Va, and Vsweep through one data signal line 410, and may sense current flowing to the driving transistor 125-1.

For this, the compensation circuit 1000' may further include a switch 1040 in addition to the corrector 1010, the D/A converter 1020, and the current detector 1030. The switch 1040 may be controlled to be turn on/off by the corrector 1010 or an external processor of the compensation circuit 1000', and thus may be switched to apply data at a time when data Vw, Va, and Vsweep is applied and to detect the current flowing to the driving transistor 125-1 at a time when current Isens is detected. Since other operations are the same as those as described above with respect to the pixel circuit 400-1 of FIG. 10A, duplicate explanation thereof will be omitted.

On the other hand, through FIGS. 10A and 10B, it is exemplified that the compensation circuit 1000 or 1000' is applied to the pixel circuit 400-1 or 400-2. However, the configuration for compensating for the deviation in threshold voltage Vth or mobility μ between the transistors included in the display panel is not limited thereto, but the compensation circuit 1000 or 1000' may also be applied to other pixel circuits 400-, 600, 700, 800, and 900 as described above in a similar manner to that in FIGS. 10A and 10B.

FIG. 11 is a diagram illustrating the configuration of a display device 2000 according to an example embodiment. Referring to FIG. 11, the display device 2000 includes a display panel 500, a panel driver 200, and a processor 300.

The display panel 500 includes a plurality of pixel circuits 100. Here, the pixel circuits 100 may be all kinds of pixel circuits 400, 400', 600, 700, 800, 900, 400-1, and 400-2 as described above.

Specifically, the display panel 500 may be configured so that gate lines G1 to Gn and data lines D1 to Dm are formed to mutually cross each other, and pixel circuits 100 are formed in regions prepared through such a mutual cross. For example, each of the plurality of pixel circuits 100 may be configured so that adjacent R, G, and B sub-pixels constitute one pixel, but is not limited thereto.

On the other hand, for convenience in illustration, only gate signal lines G1 to Gn for the gate driver 230 to apply a control signal to each pixel circuit 100 included in the display panel 500 and data signal lines D1 to Dm for the data driver 220 to apply a data signal to each pixel circuit 100 are illustrated in FIG. 11. However, other data signal lines or control signal lines may be further included in accordance with various example embodiments of the pixel circuit.

For example, in an example embodiment 400' or 900 in which Vw and Vsweep for the pulse width setup and Va for the amplitude setup are separated and applied to separate data signal lines, in an example embodiment 600 in which the amplitude is set in the current programming scheme, and in an example embodiment in which the compensation circuit 1000 or 1000' is applied, two kinds 410-1 and 410-2 of data signal lines D1 to Dm may be provided. Further, according to various example embodiments, since the control signals GATE(n) and RES(n) should be applied to the pixel circuits for the amplitude setup and the pulse width setup of the drive current Id, also two kinds of gate signal lines G1 to Gn may be provided.

The panel driver 200 may drive the display panel 500, more specifically, the plurality of pixel circuits 100, under the control of the processor 300, and may include a timing controller 210, a data driver 220, and a gate driver 230.

The timing controller 210 may receive an input signal IS, a horizontal synchronization signal Hsync, a vertical synchronization signal Vsync, and a main clock signal MCLK from an outside, and may generate and provide an image data signal, a scan control signal, a data control signal, and a light emitting control signal to the display panel 500, the data driver 220, and the gate driver 230.

In particular, according to various example embodiments, the timing controller 210 may apply a control signal CGC to transistors 150 and 150' of the pixel circuits 400, 400', 600, 700, 800, 900, 400-1, and 400-2, and may apply a control signal CIE to transistors 144 and 144' of the pixel circuits 400, 400', 600, 700, 800, 900, 400-1, and 400-2.

The data driver (or source driver) 220 is a means for generating data signals, and generates the data signals through transfer of image data of R/G/B components from the processor 300. Further, the data driver 220 may apply various kinds of data signals being generated to the display panel 500.

In particular, although not clearly illustrated in FIG. 11, according to various example embodiments, the data driver 220 may apply the amplitude setup voltage and the pulse width setup voltage for setting the amplitude and the pulse width of the drive current Id, the linearly changed voltages Va, Vw, and Vsweep, and the specific voltage Vx applied to the gate terminals of the drive transistors 125-1 and 125-2 for detecting current flowing to the driving transistors 125-1 and 125-2 to the respective pixel circuits 400, 400', 600, 700, 800, 900, 400-1, and 400-2 through the data signal lines 410, 410-1, and 410-2 included in the display panel 500.

The gate driver 230 is a means for generating a gate signal (in other words, scan signal) GATE(n), a reset signal RES (n), and various kinds of control signals, such as SENS(n), and transfers the generated control signals to a specific row of the display panel 500.

In particular, a data signal (e.g., amplitude setup voltage Va) output from the data driver 220 may be transferred to the pixel circuit 100 to which the gate signal GATE(n) is transferred. Further, an input-end voltage (A point voltage) of the inverter 141 or 141' of the pixel circuit 100 to which the reset signal RES(n) is transferred may be set to a predetermined voltage (e.g., if the inverter is a MOSFET, MOSFET threshold voltage). Further, the pixel circuit 100 to which the control signal SENS(n) is transferred may enable the current detector 1030 of the compensation circuit 1000 or 1000' to branch the current flowing to the driving transistor 125 of the current source 120.

Further, according to an example embodiment, the gate driver 230 may apply the drive voltage VDD to a drive voltage terminal 121 of the pixel circuit 100.

On the other hand, under the control of the processor 300, the panel driver 200 may control the luminance of the light emitting element 130, that is, LED element, using at least one of pulse width modulation (PWM) for varying the duty ratio of the driving current Id and pulse amplitude modulation (PAM) for varying the amplitude of the drive current Id. Here, explanation will be made on the assumption that LED includes OLED. Further, a pulse width modulation (PWM) signal controls the ratio of turn-on/off of light sources, and the duty ratio [%] is determined in accordance with a dimming value input from the processor 300.

The panel driver 200 may be implemented by a plurality of LED driving modules. According to circumstances, each of the plurality of LED driving modules may be implemented to include a sub processor for controlling the operation of each pixel circuit 100 and a driving module for driving each display module in accordance with the control of the sub processor. In this case, the driving module of the sub processor may be implemented by hardware, software, firmware or integrated chip (IC). According to an example embodiment, each sub processor may be implemented by separated semiconductor ICs.

On the other hand, each of the plurality of LED driving modules may include at least one LED driver controlling the current applied to the LED element. The LED driver may be provided in each of a plurality of LED regions including a plurality of LED elements. Here, the LED region may be a region that is smaller than the LED module as described above. For example, one LED module may be divided into a plurality of LED regions including a predetermined number of LED elements, and an LED driver may be provided in each of the plurality of LED regions. In this case, current control becomes possible for each region, but is not limited thereto. The LED driver can be provided in the unit of an LED module.

In an example embodiment, the LED driver may be deployed at the rear end of a power supply to receive a voltage applied from the power supply. In another example embodiment, the LED driver may receive a voltage from a separate power supply. Further, it is also possible that an SMPS and an LED driver are implemented in the form of one integrated module.

In various example embodiments, the LED driver may use both PAM and PWM schemes, and through this, various grayscales of an image can be expressed.

The processor 300 controls the overall operation of the display device 2000. In particular, the processor 300 may control the panel driver 200 to drive the display panel 500, and thus can perform the operations of various kinds of pixel circuits 400, 400', 600, 700, 800, 900, 400-1, and 400-2 as described above. For this, the processor 300 may be implemented by one or more of a central processing unit (CPU), a microcontroller, an application processor (AP), a communication processor (CP), and an ARM processor.

Specifically, in an example embodiment, the processor 300 may control the panel driver 200 to set the pulse width of the drive current Id in accordance with the pulse width setup voltage Vw, and to set the amplitude of the drive current Id in accordance with the amplitude setup voltage Va. In this case, if the display panel 500 is composed of n rows and m columns, the processor 300 may control the panel driver 200 to set the amplitude or pulse width of the drive current Id in the unit of a row.

Thereafter, the processor 300 may simultaneously apply the drive voltage VDD to the current sources 120 of the plurality of pixel circuits 100 included in the display panel 500, and may control the panel driver 200 to apply the linearly changed voltage Vsweep to the respective pulse width control circuits 140 of the plurality of pixel circuits 100 to display an image.

In this case, since the detailed contents that the processor 300 controls the panel driver 200 to control the operation of the respective pixel circuits 100 included in the display panel 500 are the same as those as described above with reference to FIGS. 1 to 10B, duplicate explanation thereof will be omitted.

Figure 12:
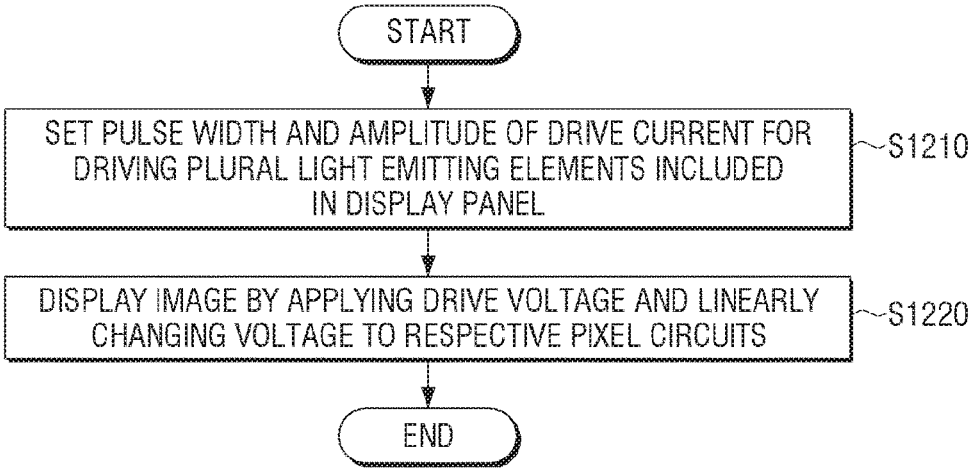
FIG. 12 is a flowchart illustrating a method for driving a display device according to an example embodiment.

FIG. 12 is a flowchart illustrating a method for driving a display device 2000 according to an example embodiment. Referring to FIG. 12, the display device 2000 may set the pulse width and the amplitude of the drive current Id for driving the respective light emitting elements 130 of the plurality of pixel circuits 100 included in the display panel 500 (S1210). In this case, if the display panel 500 is composed of n rows and m columns, the display device 2000 may set the amplitude or the pulse width of the drive current Id simultaneously in the unit of a row, but is not limited thereto.

On the other hand, the light emitting elements 130 included in the pixel circuits 100 may be classified into LEDs and OLEDs, but are not limited thereto. Further, the pixel circuit 100 may be composed of TFTs, and in this case, the channel of the TFT may be made of oxide or an organic material.

Further, in an example embodiment, the transistor constituting the pixel circuit 100 may be an NMOSFET or a PMOSFET only, but is not limited thereto. The pixel circuit 100 may be implemented to include CMOSFETs.

Further, in an example embodiment, if one data signal line 410 is provided, the pulse width setup and the amplitude setup should be performed at different times. However, in another example embodiment, if two data signal lines 410-1 and 410-2 are provided, the pulse width setup and the amplitude setup may be simultaneously performed.

On the other hand, the amplitude setup of the drive current may be performed in the voltage programming scheme or in the current programming scheme according to example embodiments. Further, in an example embodiment, if the display panel 500 is configured through application of the compensation circuit 1000 to the pixel circuit 100, the display device 2000 may set the amplitude and the pulse width of the drive current Id using the amplitude setup voltage Va and the pulse width setup voltage Vw corrected through the compensation circuit 1000, and thus the deviation in threshold voltage Vth and mobility μ between the TFT transistors can be reduced to heighten the luminance uniformity.

On the other hand, if both the amplitude and the pulse width of the drive current Id are set as described above, the display device 2000 applies the drive voltage VDD and the linearly changed voltage Vsweep to the respective pixel circuits 100 to display the image frame (S1220).

Specifically, if the drive voltage VDD is applied to the current source 120 of each pixel circuit 1000, the light emitting element 130 of the pixel circuit 100 starts to emit light in accordance with the drive current Id having the set amplitude, and if the gate terminal voltage of the driving transistor 125 becomes the ground voltage (if the driving transistor 125-1 is an NMOSFET) or the drive voltage VDD (if the driving transistor 125-2 is a PMOSFET) in accordance with the linearly changed voltage, the driving transistor 125 stops to emit light, and thus an image with various grayscales can be displayed. Since other detailed contents are the same as those as described above with reference to FIGS. 1 to 10, duplicate explanation thereof will be omitted.

Figure 13:
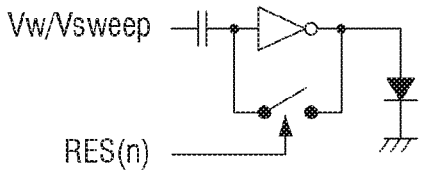
FIG. 13 illustrates conceptual diagrams for comparing a pixel circuit according to an example embodiment with a pixel circuit in the related art.
Figure 13:
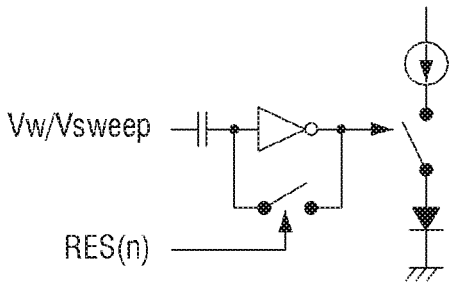
Figure 13:
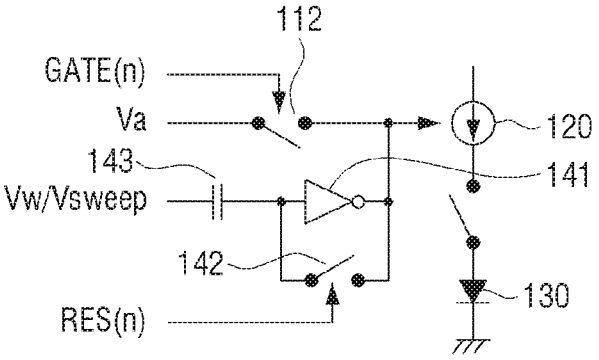

FIG. 13 is conceptual diagrams for comparing a pixel circuit according to an example embodiment with a pixel circuit in the related art. (a) and (b) of the FIG. 13 represent the related art, and (c) of the FIG. 13 represents a pixel circuit according to an example embodiment.

(a) of the FIG. 13 illustrates a scheme for directly controlling the light emitting element through the output end of the inverter. In this case, since the driving transistor of the light emitting element operates in a linear operating region, the deviation of the drive current due to the deviation of the forward voltage Vf between the light emitting elements becomes large, and thus the luminance uniformity becomes lowered.

On the other hand, (b) of the FIG. 13 illustrates a scheme for controlling the switch located between the current source and the light emitting element through the output end of the inverter. In this case, since the inverter is implemented by a CMOSFET and oxide is unable to be used as the channel material of the TFT, the manufacturing process is limited, and unnecessary reactive power consumption occurs in the series switch.

In contrast, as illustrated in (c) of the FIG. 13, in an example embodiment, if a scheme for directly controlling the current source 120 through the output end of the inverter is taken, it is possible to configure the TFT using any one kind of MOSFET, such as an NMOSFET or a PMOSFET, and thus the production cost can be saved and the yield can be improved as compared with the related art requiring the CMOSFET (of course, the pixel circuit according to the present disclosure can be implemented by the CMOSFET (see FIG. 7)).

Further, since a separate switch is not necessary between the current source 120 and the light emitting element 130, unnecessary reactive power consumption can be prevented from occurring.

Further, since the amplitude setting circuit (PAM circuit) is used together with the pulse width control circuit (PWM circuit) as hybrid, it is possible to set the operating point through the amplitude setting circuit and to control the driving transistor to operate in the saturation region, and thus the luminance deviation can be reduced even if there is a deviation in forward voltage Vf between the light emitting elements 130.

On the other hand, in various example embodiments as described above, the operation of the processor 300 of the display device 2000 or the method for driving the display device 2000 may be created by software and installed in the display device.

For example, a non-transitory computer readable medium may be provided to store therein a program for performing a method for driving a display device including setting the pulse width and the amplitude of the drive current Id for driving the respective light emitting elements 130 of the plurality of pixel circuits 100 included in the display panel 500 and displaying an image by applying the drive voltage VDD and the linearly changed voltage Vsweep to the respective pixel circuits 100.

Here, the non-transitory computer readable medium is not a medium that stores data for a short period, such as a register, a cache, or a memory, but means a medium which semi-permanently stores data and is readable by a device. Specifically, the above-described various middleware or programs may be stored and provided in the non-transitory computer readable medium, such as, a CD, a DVD, a hard disc, a Blu-ray disc, a USB, a memory card, and a ROM.

The foregoing example embodiments and advantages are merely exemplary and are not to be construed as limiting the present disclosure. The present teaching can be readily applied to other types of apparatuses. Also, the description of the example embodiments is intended to be illustrative, and not to limit the scope of the claims, and many alternatives, modifications, and variations will be apparent to those skilled in the art.

What is claimed is:

1. A pixel circuit of a display panel comprising:

a light emitting diode configured to emit light in accordance with a drive current;

a current source comprising a driving transistor connected to the light emitting diode, and the current source is configured to provide the drive current having a different amplitude to the light emitting diode in accordance with a level of a voltage applied to a gate terminal of the driving transistor;

an amplitude setting circuit configured to apply a voltage having a different level to the gate terminal of the driving transistor; and a pulse width control circuit configured to control a duration of the drive current by controlling the voltage applied to the gate terminal of the driving transistor, wherein the pulse width control circuit comprises an inverter having an output end connected to the gate terminal of the driving transistor, and a switching element connected between an input end and the output end of the inverter to set a voltage of the input end of the inverter to a predetermined threshold voltage while the switching element is turned on.

2. The pixel circuit as claimed in claim 1, wherein the driving transistor operates in a saturation region of an operation region of the driving transistor.

3. The pixel circuit as claimed in claim 1, wherein the amplitude setting circuit comprises:

a first capacitor having a first end connected to a first end of the driving transistor, and a first transistor having a first end commonly connected to a second end of the first capacitor and the gate terminal of the driving transistor and a second end configured to receive an input of an amplitude setup voltage.

4. The pixel circuit as claimed in claim 3, wherein the amplitude setting circuit is further configured to charge the first capacitor with the amplitude setup voltage while the first transistor is turned on in accordance with a first enable signal input to a gate terminal of the first transistor, and apply the voltage charged in the first capacitor to the gate terminal of the driving transistor.

5. The pixel circuit as claimed in claim 4, wherein the current source is further configured to, in response to a drive voltage being applied to the current source in a state in which the voltage charged in the first capacitor is applied to the gate terminal of the driving transistor, provide to the light emitting diode the drive current having an amplitude corresponding to a level of the voltage charged in the first capacitor.

6. The pixel circuit as claimed in claim 3, wherein the amplitude setting circuit comprises a second transistor having a first end connected to a second end of the driving transistor, a gate terminal connected to a gate terminal of the first transistor, and a second end configured to receive an input of an amplitude setup current, wherein the amplitude setting circuit is further configured to charge the first capacitor with a voltage corresponding to the amplitude setup current while the first transistor and the second transistor are turned on in accordance with a first enable signal input to a gate terminal of the first transistor, and apply the voltage charged in the first capacitor to the gate terminal of the driving transistor.

7. The pixel circuit as claimed in claim 1, wherein in response to a first voltage applied to the input end of the inverter being linearly changed to reach a predetermined threshold voltage, a voltage of the output end of the inverter becomes a ground voltage or a drive voltage of the current source to control the duration of the drive current.

8. The pixel circuit as claimed in claim 7, wherein the pulse width control circuit comprises:

a complementary metal oxide semiconductor field effect transistor (CMOSFET) inverter having an output end connected to the input end of the inverter;

a third capacitor having a first end connected to an input end of the CMOSFET inverter; and a switching element connected between the input end and the output end of the CMOSFET inverter, wherein if the switching element is turned on while a pulse width setup voltage is input to a second end of the third capacitor, the input end of the inverter is set to the predetermined threshold voltage while the switching element is turned on, and in response to the input of the pulse width setup voltage being completed, the voltage of the input end of the inverter is changed from the predetermined threshold voltage to the first voltage.

9. The pixel circuit as claimed in claim 7, wherein the drive current sustains from a time when the drive voltage is applied to the current source to a time when the voltage of the output end of the inverter becomes the ground voltage or the drive voltage.

10. The pixel circuit as claimed in claim 7, wherein the pulse width control circuit comprises:

a second capacitor having a first end connected to the input end of the inverter, wherein if the switching element is turned on while a pulse width setup voltage is input to a second end of the second capacitor, the input end of the inverter is set to the predetermined threshold voltage while the switching element is turned on, and in response to the input of the pulse width setup voltage being completed, the voltage of the input end of the inverter changes from the predetermined threshold voltage to the first voltage.

11. The pixel circuit as claimed in claim 10, wherein the first voltage is a difference value between the predetermined threshold voltage and the pulse width setup voltage.

12. The pixel circuit as claimed in claim 10, wherein the pulse width control circuit is configured to linearly change the first voltage as the drive voltage is applied to the current source and a linearly changing voltage is input to the second end of the second capacitor.

13. The pixel circuit as claimed in claim 10, wherein each of the inverter and the switching element is an N-channel metal oxide semiconductor field effect transistor (NMOSFET), the inverter comprises a drain terminal connected to the gate terminal of the driving transistor, a gate terminal connected to the first end of the second capacitor, and a source terminal connected to a ground, the switching element comprises a drain terminal commonly connected to the gate terminal of the inverter and the first end of the second capacitor, and a source terminal commonly connected to the drain terminal of the inverter and the gate terminal of the driving transistor, and in response to the first voltage applied to the gate terminal of the inverter being linearly increased and reaching the predetermined threshold voltage, a voltage of the drain terminal of the inverter becomes the ground voltage.

14. The pixel circuit as claimed in claim 13, wherein the pulse width control circuit is configured so that in response to a second enable signal being input to a gate terminal of the switching element while a pulse width setup voltage of a second voltage is input to the second end of the second capacitor, the voltage of the gate terminal of the inverter is set to the predetermined threshold voltage while the switching element is turned on in accordance with the second enable signal, and as the pulse width setup voltage is dropped from the second voltage to a zero voltage, the voltage of the gate terminal of the inverter is dropped from the predetermined threshold voltage to the first voltage.

15. The pixel circuit as claimed in claim 10, wherein each of the inverter and the switching element is a P-channel metal oxide semiconductor field effect transistor (PMOSFET), the inverter comprises a drain terminal connected to the gate terminal of the driving transistor, a gate terminal connected to the first end of the second capacitor, and a source terminal connected to a drive voltage input end of the current source, the switching element comprises a source terminal commonly connected to the gate terminal of the inverter and the first end of the second capacitor, and a drain terminal commonly connected to the drain terminal of the inverter and the gate terminal of the driving transistor, and in response to the first voltage applied to the gate terminal of the inverter being linearly decreased and reaching the predetermined threshold voltage, a voltage of the drain terminal of the inverter becomes the drive voltage of the current source.

16. The pixel circuit as claimed in claim 15, wherein the pulse width control circuit is configured so that if a third enable signal is input to a gate terminal of the switching element while a pulse width setup voltage of a third voltage is input to the second end of the second capacitor, the voltage of the gate terminal of the inverter is set to the predetermined threshold voltage while the switching element is turned on in accordance with the third enable signal, and as the pulse width setup voltage rises from the third voltage to a zero voltage, the voltage of the gate terminal of the inverter rises from the predetermined threshold voltage to the first voltage.

17. The pixel circuit as claimed in claim 10, further comprising:

a third transistor configured to electrically separate the amplitude setting circuit and the pulse width control circuit from each other until the drive voltage is applied to the current source.

18. A display device comprising:

a display panel comprising pixel circuits, and the display panel is configured to display an image;

a panel driver configured to drive the display panel; and a processor configured to express grayscales of the image based on at least one from among an amplitude and a duration of a drive current applied to a light emitting diode included in the pixel circuits, wherein each of the pixel circuits comprises:

the light emitting diode configured to emit light in accordance with the drive current;

a current source comprising a driving transistor connected to the light emitting diode, and the current source is configured to provide the drive current having a different amplitude to the light emitting diode in accordance with a level of a voltage applied to a gate terminal of the driving transistor; and a pulse width control circuit configured to control the duration of the drive current by controlling the voltage applied to the gate terminal of the driving transistor, wherein the pulse width control circuit comprises an inverter having an output end connected to the gate terminal of the driving transistor, and a switching element connected between an input end and the output end of the inverter to set a voltage of the input end of the inverter to a predetermined threshold voltage while the switching element is turned on.

* * * * *